US010842708B2

(12) United States Patent
Le et al.

(10) Patent No.: US 10,842,708 B2
(45) Date of Patent: Nov. 24, 2020

(54) MASSAGE APPARATUS FOR LEGS AND FEET AND MASSAGE CHAIR HAVING THE MASSAGE APPARATUS

(71) Applicants: Kevin Le, Richland Hills, TX (US); Thanh Le, Grand Prairie, TX (US); Varad Nitin Gokhale, Irving, TX (US)

(72) Inventors: Kevin Le, Richland Hills, TX (US); Thanh Le, Grand Prairie, TX (US); Varad Nitin Gokhale, Irving, TX (US)

(73) Assignee: Luraco, Inc., Arlington, TX (US)

( * ) Notice: Subject to any disclaimer, the term of this patent is extended or adjusted under 35 U.S.C. 154(b) by 0 days.

(21) Appl. No.: 15/415,822

(22) Filed: Jan. 25, 2017

(65) Prior Publication Data

US 2018/0289582 A1 Oct. 11, 2018

(51) Int. Cl.
*A61H 15/00* (2006.01)

(52) U.S. Cl.
CPC ..... *A61H 15/0078* (2013.01); *A61H 15/00* (2013.01); *A61H 2015/0007* (2013.01); *A61H 2015/0014* (2013.01); *A61H 2015/0021* (2013.01); *A61H 2201/0149* (2013.01); *A61H 2201/5058* (2013.01);
(Continued)

(58) Field of Classification Search
CPC ..... A61H 15/00; A61H 15/0078; A61H 2015/0021; A61H 2015/0014; A61H 2015/0007; A61H 2205/106; A61H 2205/12; A61H 7/00; A61H 7/002; A61H 7/004; A61H 7/007; A61H 2015/0042;
(Continued)

(56) References Cited

U.S. PATENT DOCUMENTS 2,751,971 A 6/1956 Gentsch
2,891,538 A 6/1959 Moxley
(Continued)

FOREIGN PATENT DOCUMENTS

CN 1446529 A 12/2002
CN 100398081 C 7/2008
(Continued)

OTHER PUBLICATIONS

"MassageChairStore.com," downloaded Sep. 12, 2013, <URL:http://www.massagechairstore.com/>.
(Continued)

*Primary Examiner* — Colin W Stuart
(74) *Attorney, Agent, or Firm* — Hoang Steve Ngo

(57) ABSTRACT

A legs and feet massage apparatus for providing massaging effects to the legs and feet of a user includes a leg and feet frame and a legs and feet massage roller assembly. In one embodiment of an aspect of the invention, the legs and feet frame may include guide rails. Each guide rail includes an upper end, a lower end, an upper section, a lower section, a connecting section, and a guide channel. The roller assembly includes sets of massage roller devices that are spaced apart and that are rotated by a motor. The massage roller devices are moved along the guide channels by the motor whereby the massage roller devices move along the guide channels while also are adapted to provide massaging effects to the feet and legs of the user. In another aspect of the invention, a massage chair includes a legs and feet massage apparatus.

99 Claims, 20 Drawing Sheets

(52) U.S. Cl.
CPC ..... *A61H 2203/0425* (2013.01); *A61H 2205/106* (2013.01); *A61H 2205/108* (2013.01); *A61H 2205/12* (2013.01)

(58) Field of Classification Search
CPC .... A61H 2201/0149; A61H 2203/0425; A61H 2205/10; A61H 2205/108
USPC ..... 601/19, 24, 34, 35, 115, 116
See application file for complete search history.

(56) References Cited

U.S. PATENT DOCUMENTS 3,483,862 A 12/1969 Takeuchi
3,532,089 A 10/1970 Arntzenius
4,231,355 A 11/1980 Hara
4,422,448 A 12/1983 Sugai et al.
4,422,449 A 12/1983 Hamabe
4,574,786 A 3/1986 Hashimoto et al.
4,686,967 A * 8/1987 Hashimoto ..... A61H 1/00 601/116
5,020,518 A 6/1991 Spears et al.
5,233,973 A 8/1993 Gill et al.
5,304,112 A 4/1994 Mrklas et al.
5,407,330 A 4/1995 Rimington et al.
5,769,799 A 6/1998 Daughtry
5,792,047 A 8/1998 Coggins
5,827,205 A 10/1998 Iwamoto
5,876,359 A 3/1999 Bock et al.
5,993,401 A 11/1999 Inbe et al.
6,056,707 A 5/2000 Hayashi
6,171,266 B1 1/2001 Inada et al.
6,224,563 B1 5/2001 Nonoue et al.
6,312,400 B1 11/2001 Itikawa et al.
6,394,970 B1 5/2002 Maier
6,491,652 B1 12/2002 Hata et al.
6,494,850 B1 12/2002 Kitadou et al.
6,511,446 B1 1/2003 Wu
6,511,448 B1 1/2003 Furuie et al.
6,540,701 B1 4/2003 Inada
6,599,261 B1 7/2003 Chen
6,629,939 B2 10/2003 Jikiba et al.
6,656,140 B2 12/2003 Oguma et al.
6,695,799 B2 2/2004 Kitadou et al.
6,749,577 B2 6/2004 Kume et al.
6,840,914 B1 1/2005 Takamura
6,899,687 B2 5/2005 Hori et al.
6,969,361 B2 * 11/2005 Hsieh ..... A61H 15/0078 601/127
6,991,609 B2 1/2006 Kan et al.
7,081,099 B1 7/2006 Luo
7,195,604 B2 3/2007 Nakamura et al.
7,549,966 B2 6/2009 Fujii et al.
7,717,868 B2 * 5/2010 Inada ..... A61H 9/0078 601/149
7,744,548 B2 6/2010 Chen
7,789,466 B2 9/2010 Yoda et al.
7,806,840 B2 10/2010 Chen
7,828,756 B2 11/2010 Kamba et al.
7,854,710 B2 12/2010 Liang
7,947,002 B2 5/2011 Mizoguchi et al.
9,173,804 B2 * 11/2015 Ishikawa ..... A61H 15/0078
9,549,867 B1 * 1/2017 El-Messeiry ..... A61H 7/001
2002/0068887 A1 6/2002 Kikumoto et al.
2002/0138023 A1 9/2002 Kume et al.
2002/0193713 A1 12/2002 Lee
2003/0050578 A1 * 3/2003 Suh ..... A61H 7/004 601/99
2004/0097854 A1 5/2004 Hester et al.
2004/0122343 A1 6/2004 Mori et al.
2004/0158181 A1 8/2004 Watanabe et al.
2005/0010144 A1 * 1/2005 Chen ..... A61H 15/0078 601/99
2005/0059913 A1 * 3/2005 Ishiguro ..... A61H 15/0078 601/90
2005/0088028 A1 4/2005 Wan et al.
2005/0090769 A1 4/2005 Chen
2005/0101892 A1 5/2005 Dehli
2005/0113723 A1 5/2005 Ueyama et al.
2005/0146176 A1 7/2005 Yoda et al.
2005/0192520 A1 9/2005 Morita et al.
2005/0242635 A1 11/2005 Cassaday
2006/0069325 A1 3/2006 Inada et al.
2006/0111653 A1 5/2006 Nishio et al.
2006/0142676 A1 6/2006 Fujii et al.
2006/0217641 A1 9/2006 Tanizawa et al.
2006/0217643 A1 9/2006 Yonekawa et al.
2006/0241536 A1 10/2006 Yoda et al.
2006/0293618 A1 * 12/2006 Hsieh ..... A61H 7/00 601/133
2007/0010767 A1 1/2007 Hsieh
2007/0016119 A1 1/2007 Inada et al.
2007/0106185 A1 * 5/2007 Ferber ..... A61H 7/007 601/86
2007/0225624 A1 9/2007 Tsukada et al.
2007/0239089 A1 10/2007 Chiu
2007/0287941 A1 12/2007 Yoda et al.
2007/0299377 A1 12/2007 Shiraishi
2008/0009777 A1 1/2008 Chiu
2008/0097260 A1 4/2008 Tsukada et al.
2008/0183112 A1 * 7/2008 Takebe ..... A61H 9/0078 601/29
2008/0243040 A1 10/2008 Kuwabara et al.
2009/0036809 A1 2/2009 Nishio et al.
2009/0177128 A1 * 7/2009 Fukuyama ..... A61H 7/001 601/98
2009/0260639 A1 10/2009 Hsu et al.
2009/0306555 A1 12/2009 Goto
2009/0306558 A1 12/2009 Chen
2010/0030121 A1 2/2010 Fu
2010/0198120 A1 8/2010 Tago et al.
2010/0198121 A1 8/2010 Tago et al.
2010/0249613 A1 9/2010 Hashimoto
2010/0312155 A1 12/2010 Fukuyama et al.
2010/0318004 A1 12/2010 Numata et al.
2011/0015554 A1 1/2011 Morikawa et al.
2011/0055720 A1 3/2011 Potter et al.
2011/0077560 A1 * 3/2011 Jacofsky ..... A61H 1/008 601/5
2011/0077561 A1 3/2011 Choly
2011/0082400 A1 * 4/2011 Wu ..... A61H 7/00 601/99
2011/0213503 A1 9/2011 Porter, III
2012/0071799 A1 3/2012 Inada et al.
2012/0095375 A1 * 4/2012 Ishiguro ..... A61H 7/004 601/112
2012/0157899 A1 6/2012 Terada et al.
2012/0212018 A1 * 8/2012 Ishikawa ..... A47C 1/0352 297/217.1
2012/0215143 A1 * 8/2012 Inada ..... A61H 1/003 601/112
2013/0088059 A1 4/2013 Nagamitsu
2014/0343467 A1 11/2014 Fukuyama et al.
2015/0051526 A1 2/2015 Wang et al.
2015/0141887 A1 5/2015 Kawashima et al.
2015/0157528 A1 * 6/2015 Le ..... A61H 15/00 601/99
2015/0169124 A1 * 6/2015 Le ..... G06F 3/0412 345/173
2015/0313790 A1 * 11/2015 Inada ..... A61H 9/0078 601/134
2015/0351997 A1 12/2015 Le et al.
2015/0366746 A1 12/2015 Ashby
2016/0106620 A1 4/2016 Uno et al.
2016/0229320 A1 8/2016 Lem et al.
2016/0282040 A1 9/2016 Wenji et al.
2017/0056280 A1 3/2017 Ode
2017/0290739 A1 10/2017 Shin et al.
2017/0293281 A1 10/2017 Li et al.

(56) References Cited

U.S. PATENT DOCUMENTS

FOREIGN PATENT DOCUMENTS

| | | | |
|---|---|---|---|
| CN | 101396322 | | 4/2009 |
| CN | 101744707 | B | 10/2011 |
| EP | 1230904 | A2 | 8/2002 |
| EP | 1210927 | B1 | 1/2005 |
| JP | 2551492 | | 1/1994 |
| JP | H06209 | A | 1/1994 |
| JP | H1119150 | A | 1/1999 |
| JP | 11299570 | | 11/1999 |
| JP | 2000342644 | | 12/2000 |
| JP | 2001095867 | | 4/2001 |
| JP | 2001309833 | | 11/2001 |
| JP | 2002238963 | | 8/2002 |
| JP | 2002240598 | | 8/2002 |
| JP | 2004216120 | | 8/2004 |
| JP | WO2009013870 | | 1/2009 |
| KR | 200276429 | | 5/2002 |
| KR | 200438559 | | 2/2008 |
| KR | 101458685 | | 11/2014 |
| KR | 101515586 | | 4/2015 |
| WO | WO2012077842 | | 6/2012 |

OTHER PUBLICATIONS

"How Massage Chairs Work," downloaded Sep. 12, 2013, <URL:http://electronics.howstuffworks.com/gadgets/home/massage-chair1.htm>.

"Osaki OS-4000 Instruction Manual," downloaded Sep. 12, 2013, <URL:http://www.hitechmassagechairs.com/PDF/OS-4000-Manual.pdf>.

"Luminous-spa-pedicure-chair-owner-manual," downloaded Aug. 15, 2016, <URL:http://uspedicurespa.com/resources/lexor/luminous-spa-pedicure-chair-owner-manual.pdf >.

* cited by examiner

MASSAGE APPARATUS FOR LEGS AND FEET AND MASSAGE CHAIR HAVING THE MASSAGE APPARATUS

BACKGROUND OF THE INVENTION

Field of the Invention

The present invention generally relates to massage chairs and massage devices and apparatuses for massage chairs. More specifically, as one aspect of the present invention, the invention is directed to a legs and feet massage apparatus for providing massaging benefits or effects to the legs and feet of a user. As another aspect of the present invention, the invention is directed to a chair, preferably a massage chair, having a legs and feet massage apparatus.

Description of the Related Art

Massage chairs and massage devices and apparatuses for massage chairs are known in the art.

There are a number of patents, published patent applications, and/or non-patent publications directed at massage chairs and massage devices and apparatuses for massage chairs that show, describe and/or teach massage benefits or effects being provided to an upper body area, such as a back body area, of a user. Further, there are a number of patents, published patent applications, and/or non-patent publications directed at massage chairs and massage devices and apparatuses for massage chairs that show, describe and/or teach massage benefits or effects being provided to the legs and feet of a user.

The present invention overcomes one or more of the shortcomings of massage chairs and massage devices and apparatuses for massage chairs. The Applicant is unaware of inventions or patents, taken either singly or in combination, which are seen to describe the present invention as claimed.

SUMMARY OF THE INVENTION

As one aspect of the present invention, the invention is directed to a legs and feet massage apparatus for providing massaging benefits or effects to the legs and feet of a user.

As a non-limiting example, the legs and feet massage apparatus comprises: a frame; a feet massage roller assembly; two sets of calf massage devices; and a pair of limit sensors.

The frame includes a pair of opposing guide rails, an upper connecting bar, and a lower connecting bar.

Each guide rail includes an upper or first end, a lower or second end, an upper or vertical section located adjacent the upper end, a lower or horizontal section located about the lower end, a bend section connecting the vertical section and horizontal section of the corresponding guide rail, an outer side, an inner side, and a guide channel extending from the vertical section into the horizontal section and running along the inner side of the guide rail. The guide channel includes a plurality of gear teeth for engaging with a plurality of driving gears of a plurality of feet massage roller devices when the plurality of feet massage roller devices move upward and downward in a generally vertical direction along the vertical section and bend section from the upper ends toward the lower ends of the guide rails and vice versa, respectively, and moves forward and rearward in a generally horizontal direction along the horizontal section.

Each of the upper connecting bar and lower connecting bar has a first end, a second end, and a body portion extending from the first end to the second end, respectively. The upper connecting bar is secured, attached or connected to the upper ends of the guide rails, while the lower connecting bar is secured, attached or connected to the lower ends of the guide rails. The upper connecting bar and lower connecting bar help to stabilize the frame and the positioning of the guide rails relative to one another.

The feet massage roller assembly includes: a plurality of feet massage roller devices; a worm gear device; and a motor. The plurality of feet massage roller devices may be moved along the guide channels of the pair of guide rails by the motor powering the worm gear device to rotate the plurality of feet massage roller devices such that the plurality of feet massage roller devices move along the guide channels while also providing massaging benefits or effects to the bottoms or soles of the feet and backsides of the ankles and calves of the user.

Each feet massage roller device has a first end with a rotational shaft that is connected to the worm gear device, a second end that has a plurality of driving gears for engaging with the corresponding guide channel of the guide rails, and a main massage roller positioned between the first end and second end of the feet massage roller device. Each main massage roller has a plurality of smaller massage rollers surrounding the outer surface of the main massage roller. Thus, preferably, the plurality of smaller massage rollers make contact with and provide massaging benefits or effects to the bottom or sole of the feet and backside of the ankle and calves of the user as the plurality of feet massage roller devices move along the guide channels of the guide rails.

The worm gear device is in communication with or connected to the motor such that the worm gear device is powered by the motor to rotate the plurality of feet massage roller devices via the rotational shafts so that the plurality of feet massage roller devices can move along the guide channel.

The motor powers the worm gear device to rotate the plurality of feet massage roller devices via the rotational shafts so that the plurality of feet massage roller devices can move along the guide channels of the guide rails.

Each of the two sets of calf massage devices includes: a first or upper calf massage device; and a second or lower calf massage device. Both of the upper calf massage device and lower calf massage device of each set are secured or attached along the vertical section of the corresponding guide rail such that, preferably, the upper calf massage devices face toward one another and the lower calf massage devices face toward one another.

Preferably, each of the upper calf massage devices and lower calf massage devices has an attachment plate, a wiring coil secured or attached to the inner side of the attachment plate, and a metal core or plunger secured or attached to the inner side of the wiring coil. Preferably, the wiring coil is an energized solenoid coil that produces linear movement of the corresponding metal core or plunger so that punching massaging effects is provided to the calves of the user. Thus, preferably, the plurality of metal cores or plungers make contact with and provide punching massaging benefits or effects to the sides of the calves of the user when the two sets of calf massage devices are in use.

Limit sensors control the traveling distance of the plurality of feet massage roller devices along the guide channels of the guide rails in either direction, and prevent the plurality of feet massage roller devices from exiting the guide channels at either end of the guide rails.

As another aspect of the present invention, the invention is directed to a chair, preferably a massage chair, having a legs and feet massage apparatus as described above.

It should be understood that the above-attached figures are not intended to limit the scope of the present invention in any way.

DETAILED DESCRIPTION OF THE PRESENT INVENTION

Figure 1:
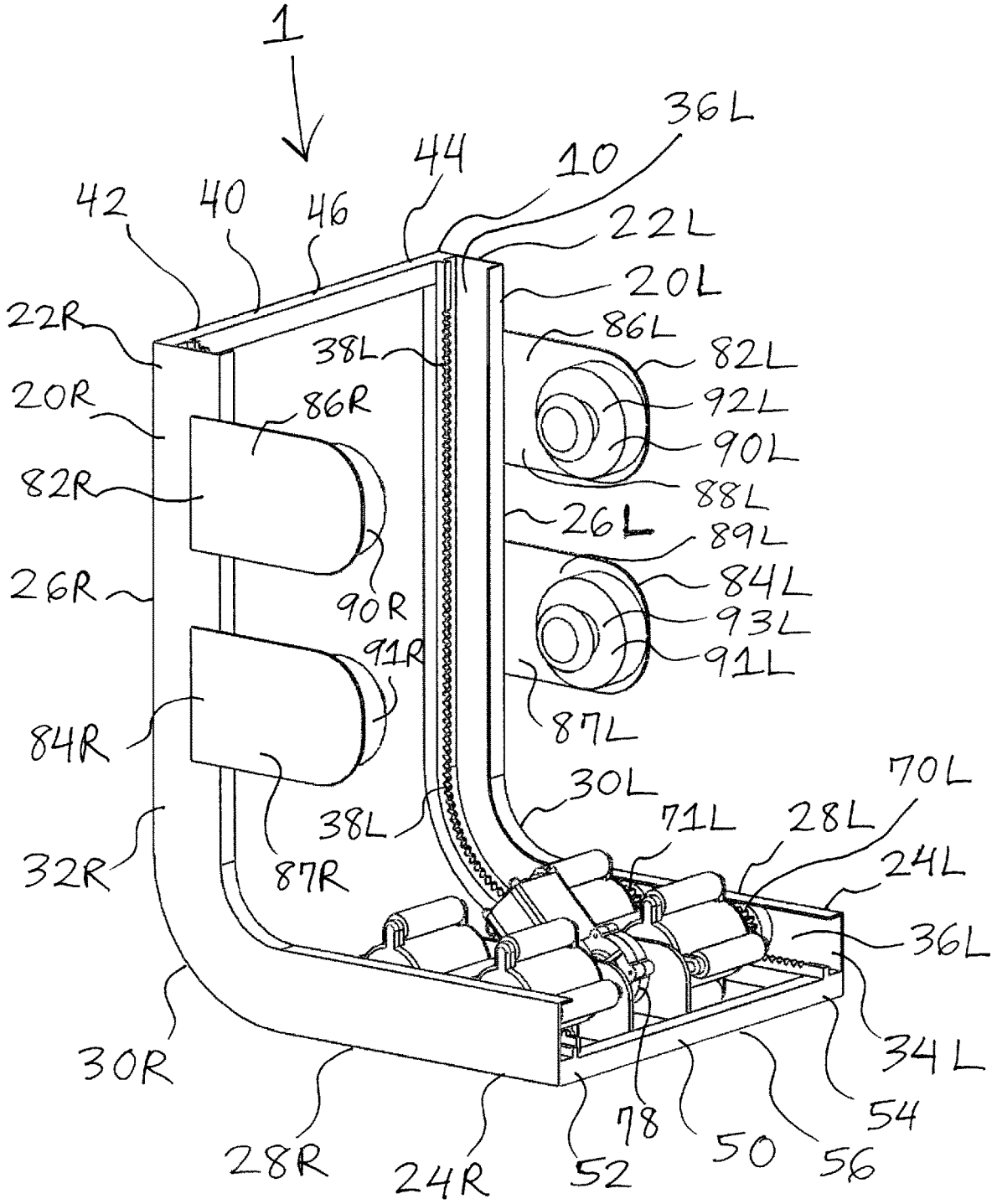
FIG. 1 is a front, right side, perspective view of a legs and feet massage apparatus according to the present invention.
Figure 2:
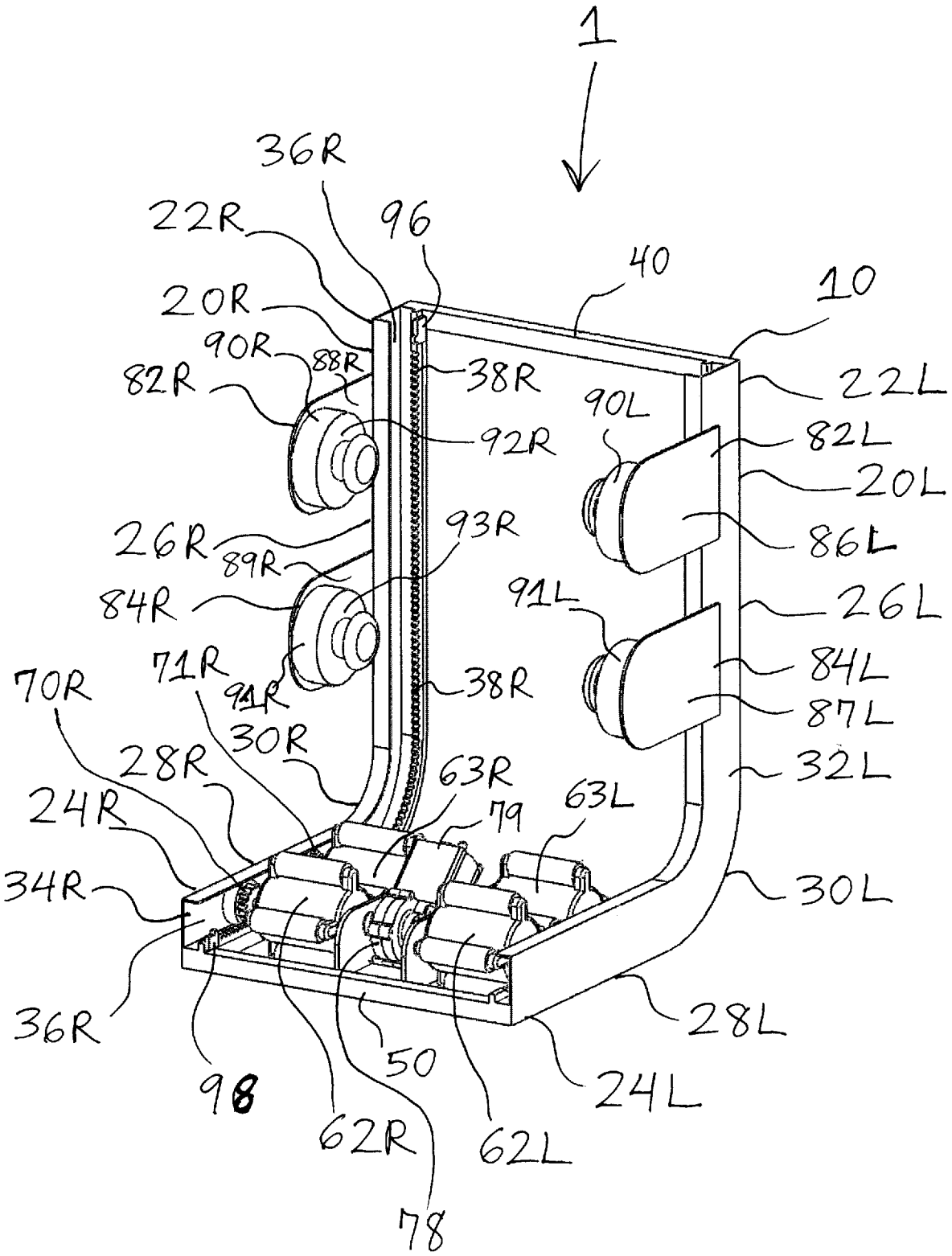
FIG. 2 is a front, left side, perspective view of the legs and feet massage apparatus of FIG. 1.
Figure 3:
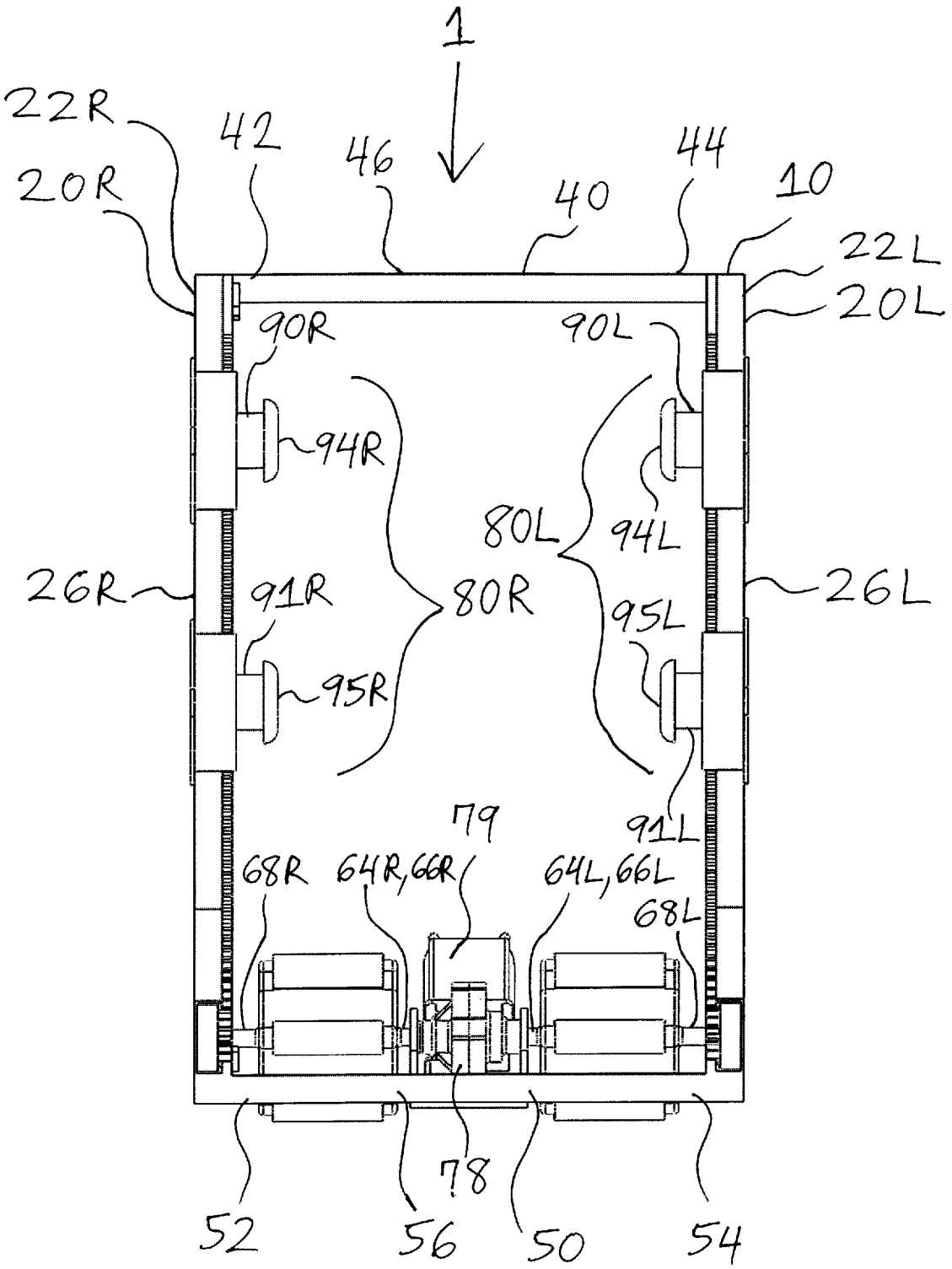
FIG. 3 is a front view of the legs and feet massage apparatus of FIG. 1.
Figure 4:
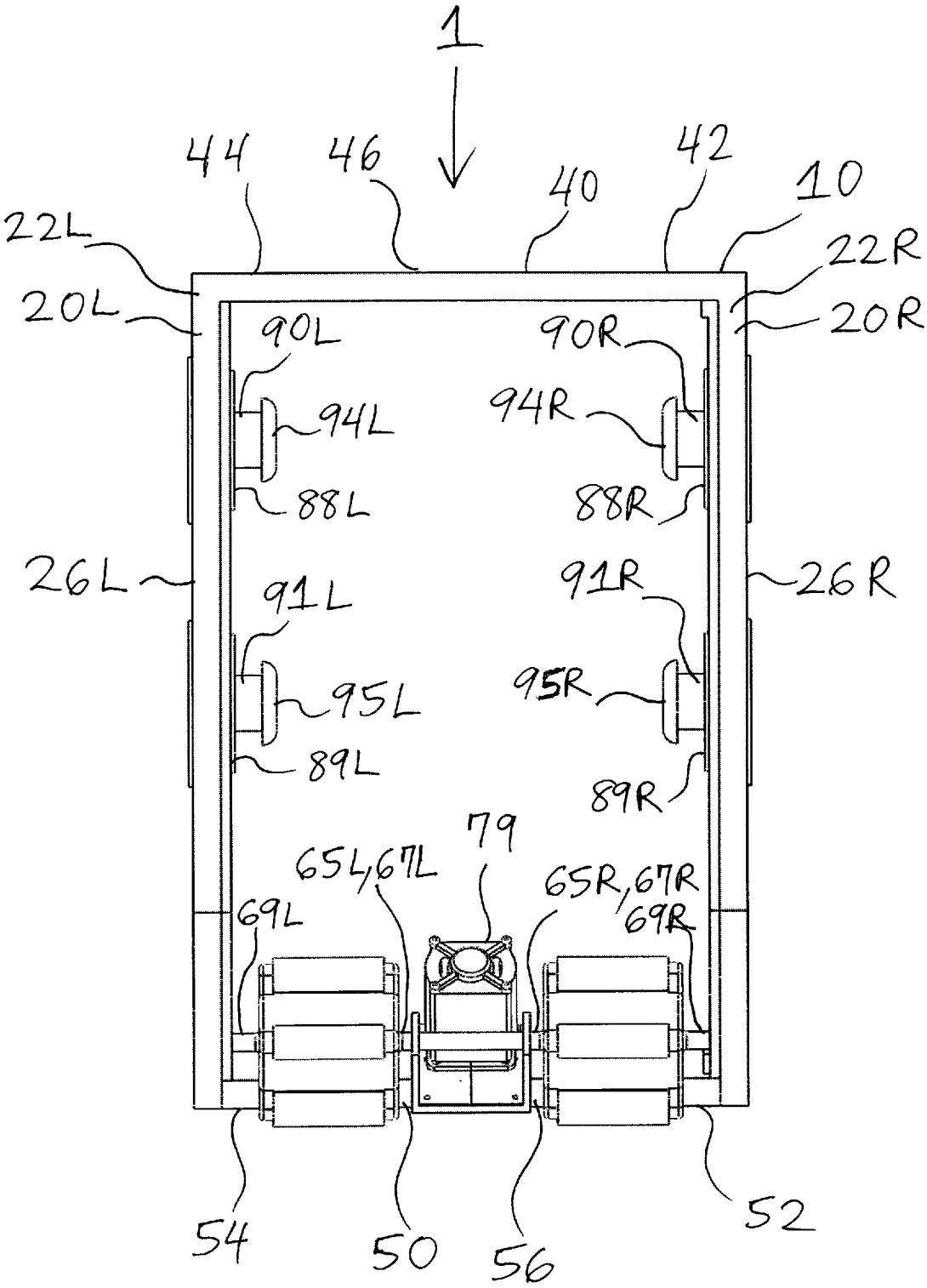
FIG. 4 is a rear view of the legs and feet massage apparatus of FIG. 1.
Figure 5:
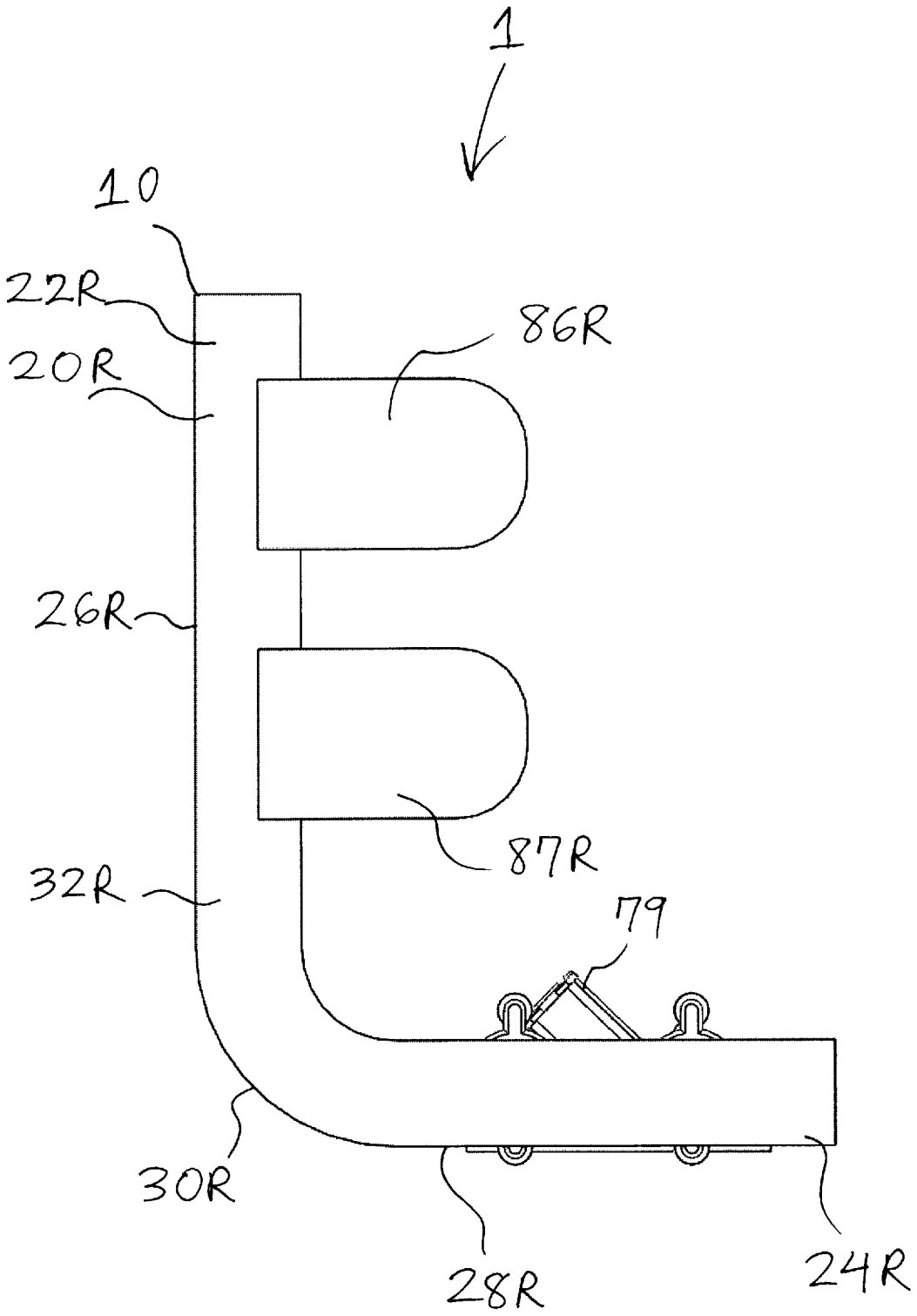
FIG. 5 is a right side view of the legs and feet massage apparatus of FIG. 1.
Figure 6:
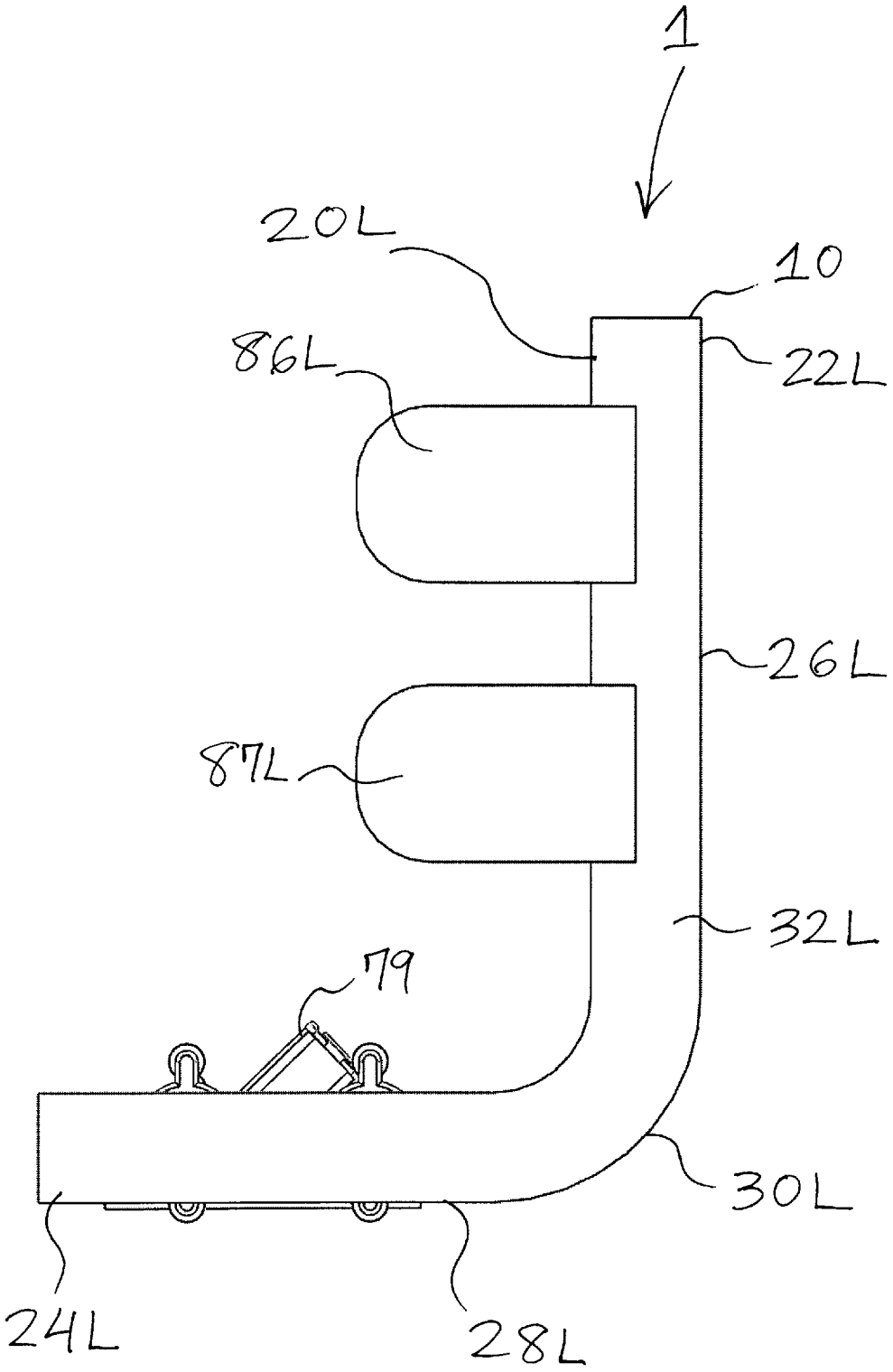
FIG. 6 is a left side view of the legs and feet massage apparatus of FIG. 1.
Figure 7:
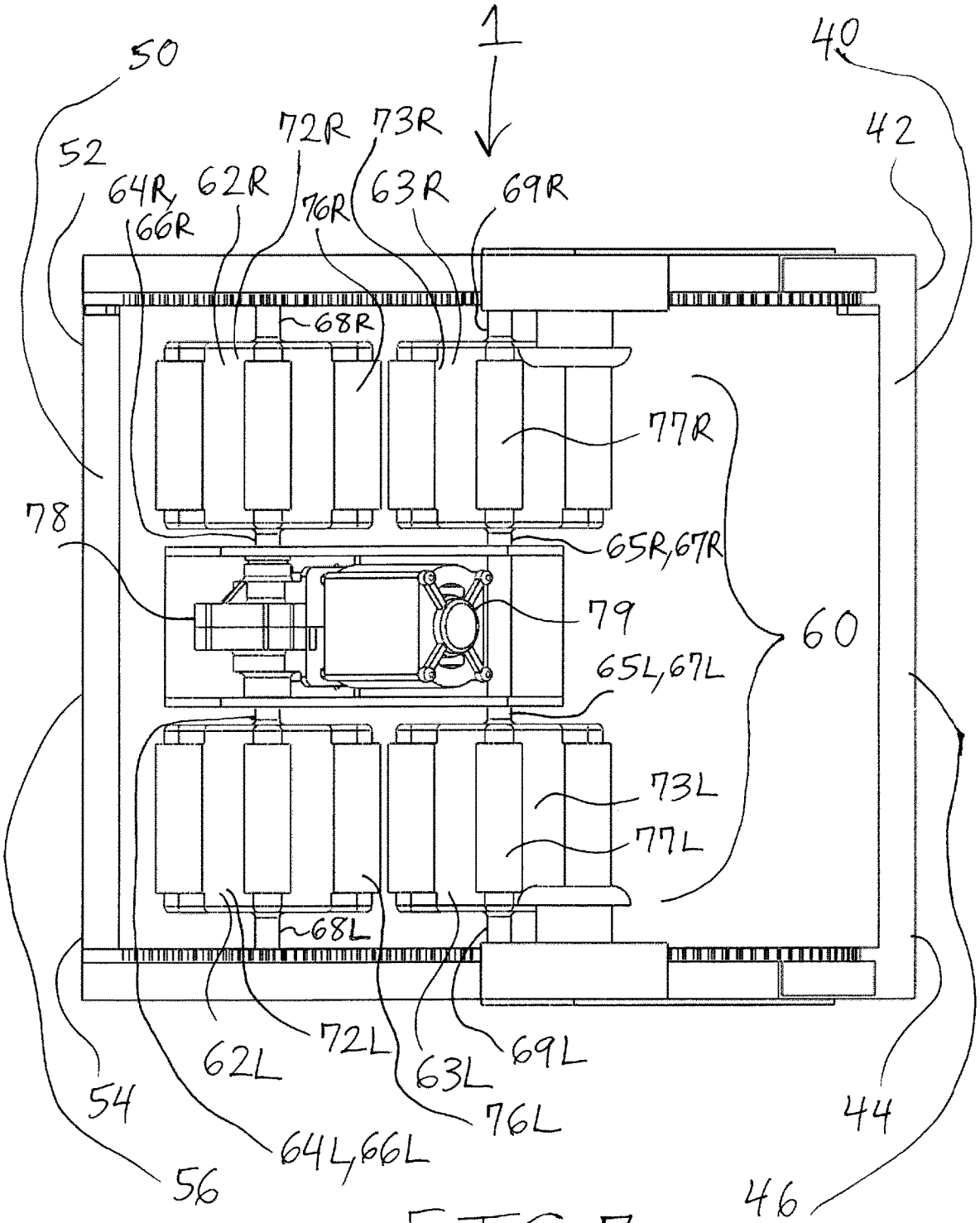
FIG. 7 is a top view of the legs and feet massage apparatus of FIG. 1.
Figure 8:
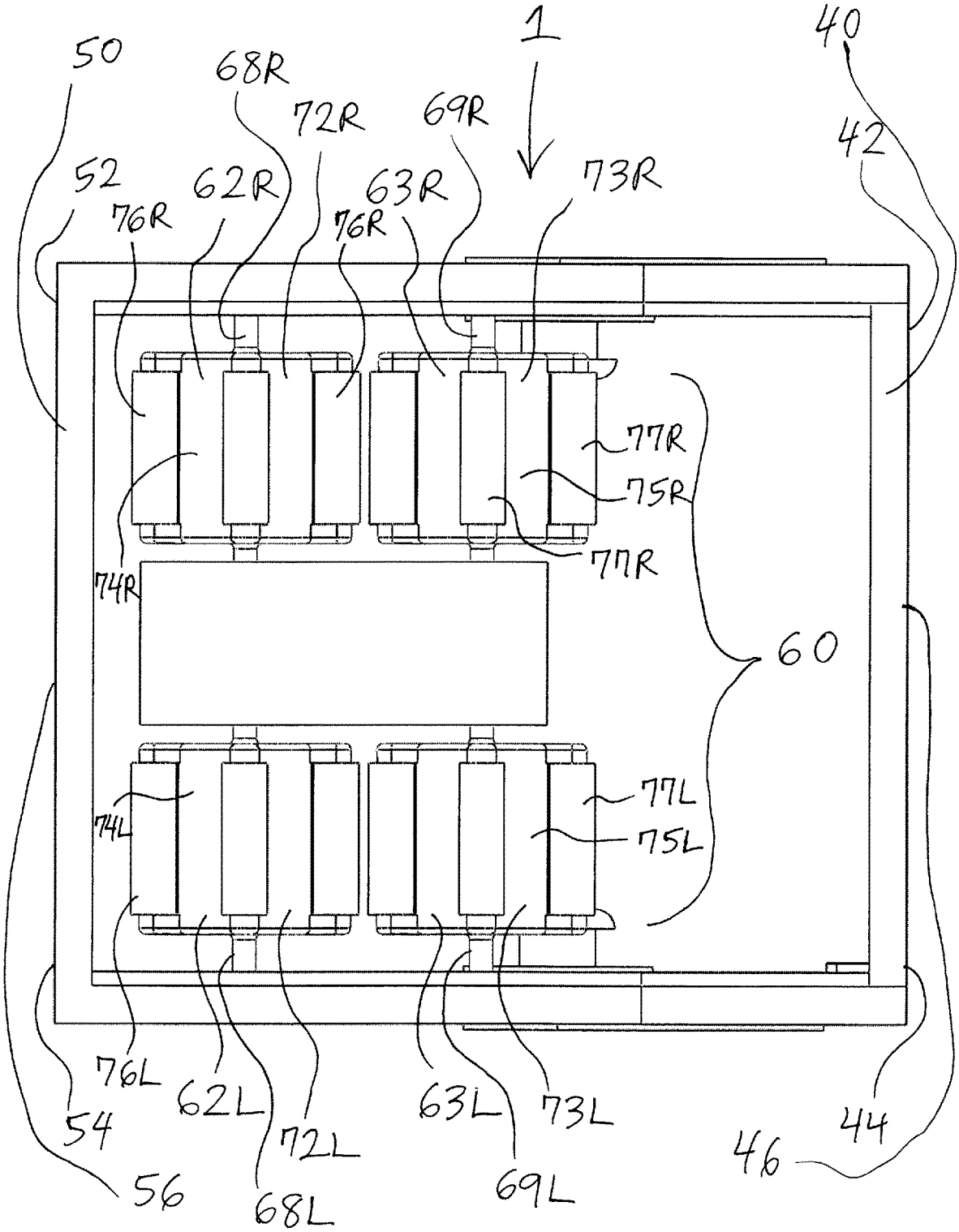
FIG. 8 is a bottom view of the legs and feet massage apparatus of FIG. 1.
Figure 9:
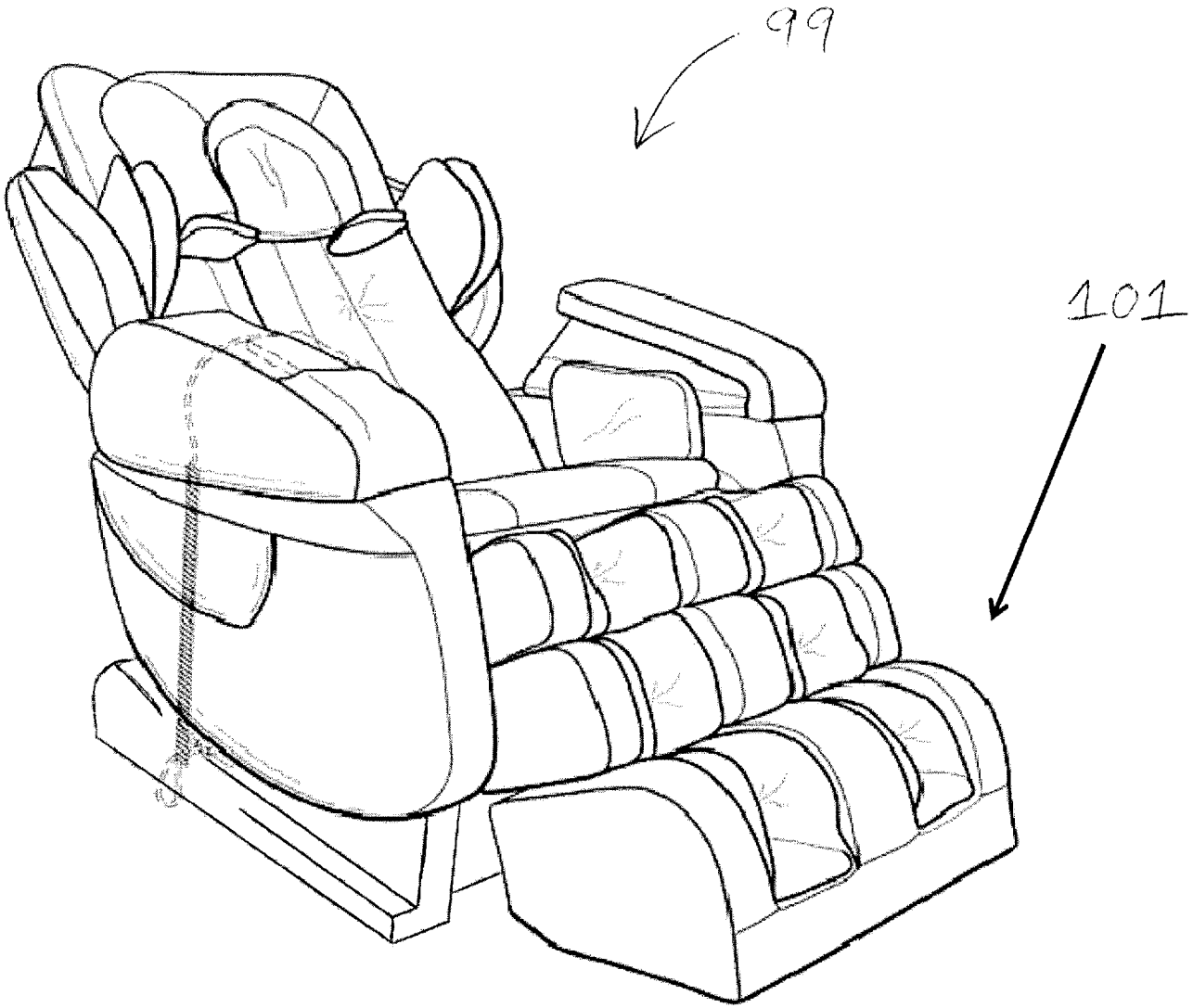
FIG. 9 is a front, perspective view of a chair having a legs and feet massage apparatus according to the present invention, wherein the legs and feet massage apparatus is positioned inside a chair covering material.
Figure 18:
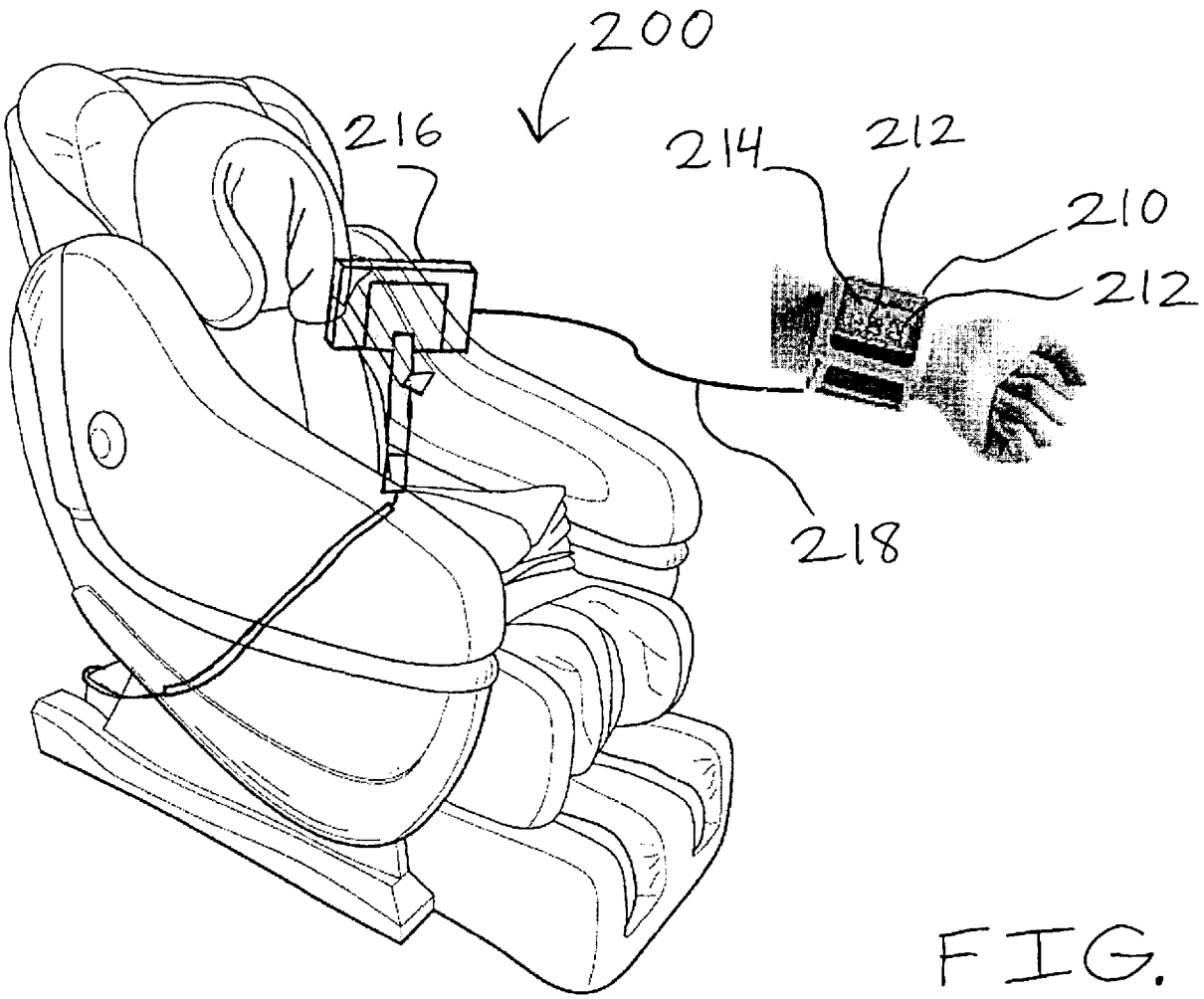
FIG. 18 is an environmental perspective, front and right side view of a massage chair according to the present invention, showing at least one health monitoring device or system being positioned on or secured to a user.

Referring to FIGS. 1-8 and as one aspect of the present invention, the invention is directed to a legs and feet massage apparatus 1 for providing massaging benefits or effects to the legs and feet of a user (not shown) wherein the legs and feet massage apparatus 1 may be secured, attached or affixed (as shown in FIGS. 9 and 18) to a chair, preferably a massage chair.

As a non-limiting example, the legs and feet massage apparatus 1 comprises: a frame 10; a feet massage roller assembly 60 (preferably motorized); two sets of calf massage devices 80R,80L; and a pair of limit sensors 96,98.

The frame 10 includes a pair of opposing guide rails 20R,20L, an upper connecting bar 40, and a lower connecting bar 50.

Preferably, the guide rails 20R,20L are substantially similar or mirror images of one another. Each guide rail 20R,20L includes an upper or first end 22R,22L, a lower or second end 24R,24L, an upper or vertical section 26R,26L located adjacent the upper end 22R,22L, a lower or horizontal section 28R,28L located about the lower end 24R,24L, a bend section 30R,30L connecting the vertical section 26R,26L and horizontal section 28R,28L of the corresponding guide rail 20R,20L, an outer side 32R,32L, an inner side 34R,34L, and a guide channel 36R,36L extending from the vertical section 26R,26L into the horizontal section 28R,28L and running along the inner side 34R,34L of the guide rail 20R,20L. The guide channel 36R,36L includes a plurality of gear teeth 38R,38L for engaging with a plurality of driving gears 70R,70L,71R,71L of a plurality of feet massage roller devices 62R,62L,63R,63L of the feet massage roller assembly 60 when the plurality of feet massage roller devices 62R,62L,63R,63L move upward and downward in a generally vertical direction along the vertical section 26R,26L and bend section 30R,30L from the upper ends 22R,22L toward the lower ends 24R,24L of the guide rails 20R,20L and vice versa, respectively, and moves forward and rearward in a generally horizontal direction along the horizontal section 28R,28L. Preferably, each of the guide rails 20R,20L has a generally "L-shaped" configuration. In this configuration, the lower portion of the "L" includes the horizontal section 28R,28L and a portion of the bend section 30R,30L, and the upper portion of the "L" includes the vertical section 26R,26L and also a portion of the bend section 30R,30L.

Each of the upper connecting bar 40 and lower connecting bar 50 has a first end 42,52, a second end 44,54, and a body portion 46,56 extending from the first end 42,52 to the second end 44,54, respectively. The upper connecting bar 40 is secured, attached or connected to the upper ends 22R,22L of the guide rails 20R,20L, while the lower connecting bar 50 is secured, attached or connected to the lower ends 24R,24L of the guide rails 20R,20L. The upper connecting bar 40 and lower connecting bar 50 help to stabilize the frame 10 and the positioning of the guide rails 20R,20L relative to one another.

The feet massage roller assembly 60 includes: the plurality of feet massage roller devices 62R,62L,63R,63L (a total of four in this embodiment); a worm gear device 78; and a motor 79. The plurality of feet massage roller devices 62R,62L,63R,63L may be moved along the guide channels 36R,36L of the pair of guide rails 20R,20L by the motor 79 powering the worm gear device 78 to rotate the plurality of feet massage roller devices 62R,62L,63R,63L such that the plurality of feet massage roller devices 62R,62L,63R,63L move along the guide channels 36R,36L while also providing massaging benefits or effects to the bottoms or soles of the feet and backsides of the ankles and calves of the user.

Each feet massage roller device 62R,62L,63R,63L has a first end 64R,64L,65R,65L with a rotational shaft 66R,66L,67R,67L that is connected to the worm gear device 78 or motor 79, respectively, a second end 68R,68L,69R,69L that has a plurality of driving gears 70R,70L,71R,71L for engaging with the corresponding guide channel 36R,36L of the guide rails 20R,20L, and a main massage roller 72R,72L, 73R,73L positioned between the first end 64R,64L,65R,65L and second end 68R,68L,69R,69L. Each main massage roller 72R,72L,73R,73L has a plurality of smaller massage rollers 76R,76L,77R,77L surrounding the outer surface 74R, 74L,75R,75L of the main massage roller 72R,72L,73R,73L. Thus, preferably, the plurality of smaller massage rollers 76R,76L,77R,77L make contact with and provide massaging benefits or effects to the bottom or sole of the feet and backside of the ankle and calves of the user as the plurality of feet massage roller devices 62R,62L,63R,63L move along the guide channels 36R,36L of the guide rails 20R,20L.

The worm gear device 78 is in communication with or connected to the motor 79 such that the worm gear device 78 is powered by the motor 79 to rotate the plurality of feet massage roller devices 62R,62L via the rotational shafts 66R,66L so that the plurality of feet massage roller devices 62R,62L,63R,63L can move along the guide channel 36R, 36L. The worm gear device 78 may be any applicable worm gear device known to one of ordinary skill in the art.

The motor 79 powers the worm gear device 78 to rotate the plurality of feet massage roller devices 62R,62L via the rotational shafts 66R,66L while itself rotating the plurality of feet massage roller devices 63R,63L via the rotational shafts 67R,67L such that the plurality of feet massage roller devices 62R,62L,63R,63L can move along the guide channels 36R,36L of the guide rails 20R,20L. The motor 79 may be any applicable motor known to one of ordinary skill in the art.

Each of the two sets of calf massage devices 80R,80L includes: a first or upper calf massage device 82R,82L; and a second or lower calf massage device 84R,84L. Both of the upper calf massage device 82R,82L and lower calf massage device 84R,84L of each set 80R,80L are secured or attached along the vertical section 26R,26L of the corresponding guide rail 20R,20L such that, preferably, the upper calf massage devices 82R,82L face toward one another and the lower calf massage devices 84R,84L face toward one another.

Preferably, each of the upper calf massage devices 82R, 82L and lower calf massage devices 84R,84L has an attachment plate 86R,86L,87R,87L, a wiring coil 90R,90L,91R, 91L secured or attached to the inner side 88R,88L,89R,89L of the attachment plate 86R,86L,87R,87L, and a metal core or plunger 94R,94L,95R,95L secured or attached to the inner side 92R,92L,93R,93L of the wiring coil 90R,90L, 91R,91L. Preferably, the wiring coil 90R,90L,91R,91L is an energized solenoid coil that produces linear movement of the corresponding metal core or plunger 94R,94L,95R,95L so that punching massaging effects is provided to the calves of the user. Thus, preferably, the plurality of metal cores or plungers 94R,94L,95R,95L make contact with and provide punching massaging benefits or effects to the sides of the calves of the user when the two sets of calf massage devices 80R,80L are in use.

Limit sensors 96,98 control the traveling distance of the plurality of feet massage roller devices 62R,62L,63R,63L along the guide channels 36R,36L of the guide rails 20R,20L in either direction, and prevent the plurality of feet massage roller devices 62R,62L,63R,63L from exiting the guide channels 36R,36L at either end of the guide rails 20R,20L. As a non-limiting example, a first limit sensor 96 may be positioned at the upper end 22R,22L of a guide rail 20R,20L, and a second limit sensor 98 may be positioned at the lower end 24R,24L of the same guide rail 20R,20L.

Figure 19:
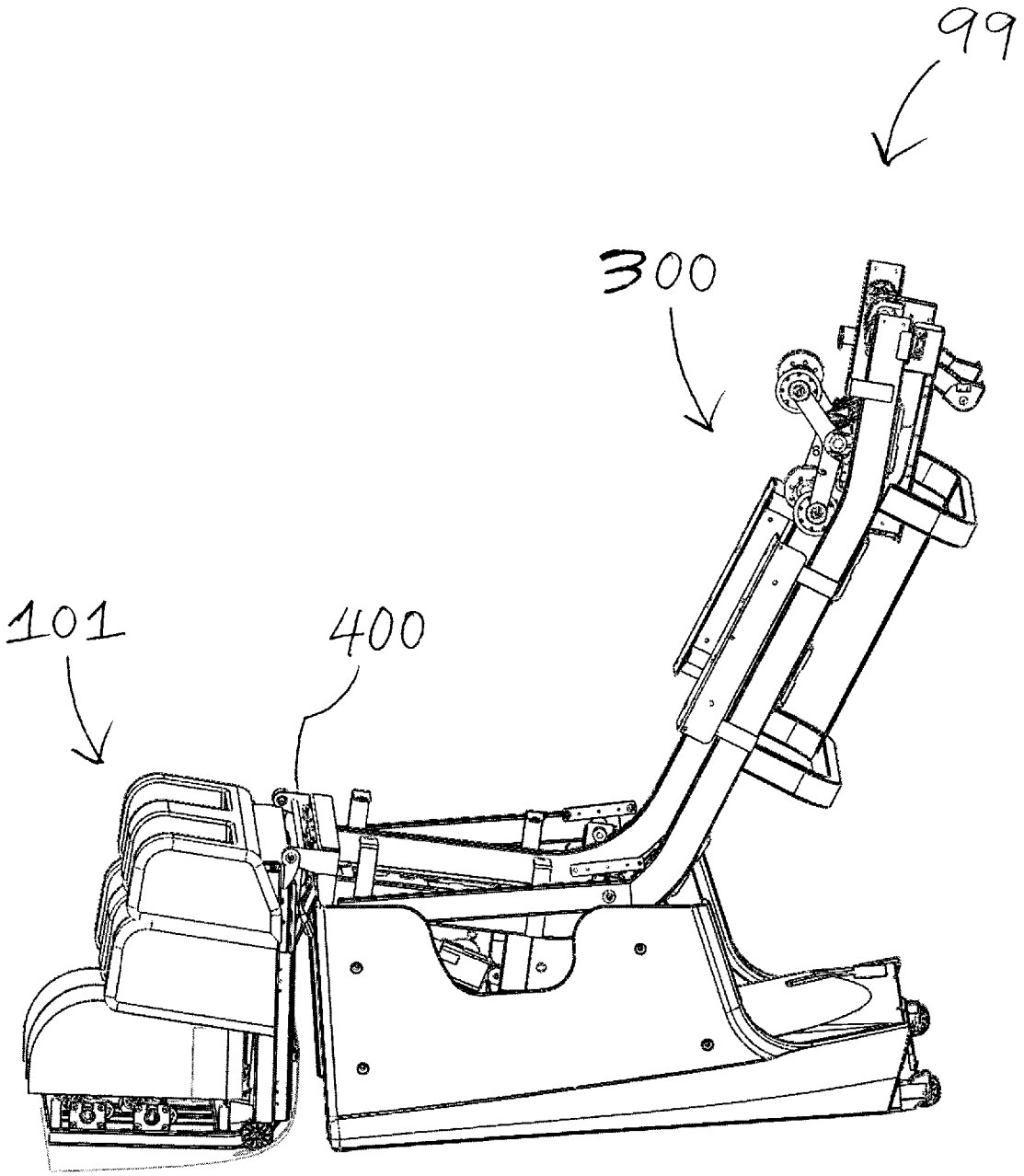
FIG. 19 is a perspective, left side view of a chair having a legs and feet massage apparatus secured to a body massage apparatus according to the present invention, wherein a chair covering material is partially revealed to show a substantial portion of the body massage apparatus, and wherein the chair covering material is partially removed to show a portion of the legs and feet massage apparatus.
Figure 20:
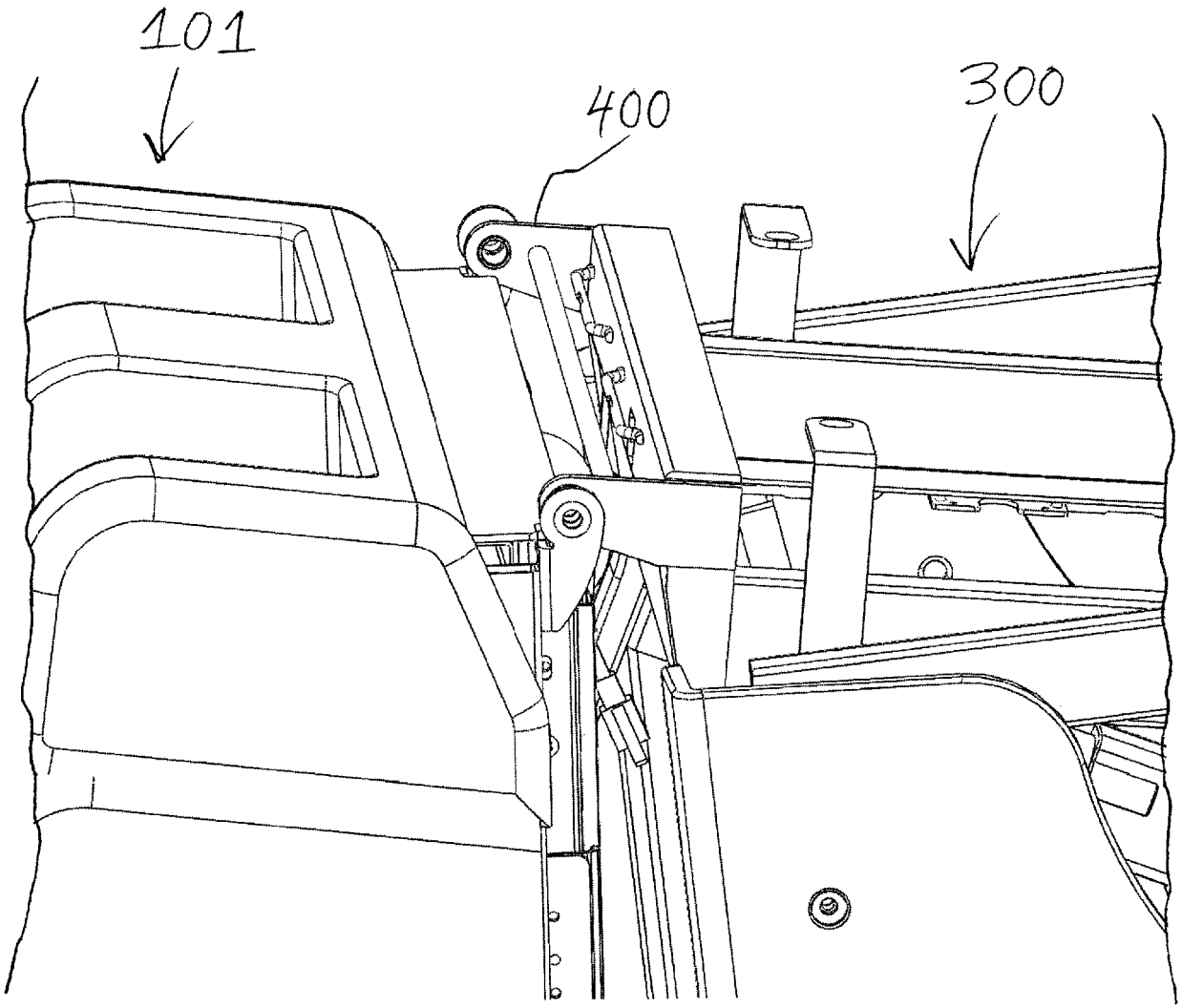
FIG. 20 is a close-up perspective view of the legs and feet massage apparatus secured to the body massage apparatus of FIG. 19.

Referring to FIGS. 9-20 and as another aspect of the present invention, the invention is directed to a chair 99, preferably a massage chair, having a legs and feet massage apparatus 101. Preferably, the legs and feet massage apparatus 101 is substantially or exactly the same as the legs and feet massage apparatus 1 described above and shown in FIGS. 1-8. As stated above and shown in FIG. 9, the legs and feet massage apparatus 101 is secured, attached or affixed to a chair 99, preferably a massage chair, and positioned inside a chair covering material, such as, but not limited to, leather, suede, a man-made material, and any other covering material known to one of ordinary skill in the art. As shown in FIG. 19, the chair covering material is partially revealed to show the legs and feet massage apparatus 101 being positioned inside the chair covering material, and the chair covering material is also partially revealed to show a substantial portion of a body massage apparatus 300. FIG. 20 shows a non-limiting example of a securing device 400 that secures the legs and feet massage apparatus 101 to the body massage apparatus 300. Preferably, body massage apparatus 300 is substantially similar to body massage apparatus 100.

Referring to FIGS. 10-18 and in one embodiment, the massage chair 99 comprises a body massage apparatus 100 wherein massage benefits or effects are provided to a back body area, a bottom body area, and a thigh body area of a user (not shown). Massage benefits or effects may also be provided to a head and neck body area of the user. The body massage apparatus 100 includes a frame 110 and a body massage device 170. Also, in another embodiment, the massage chair 200 includes a body massage apparatus and at least one health monitoring device 210. The body massage apparatus of massage chair 200 is preferably body massage apparatus 100.

Figure 10:
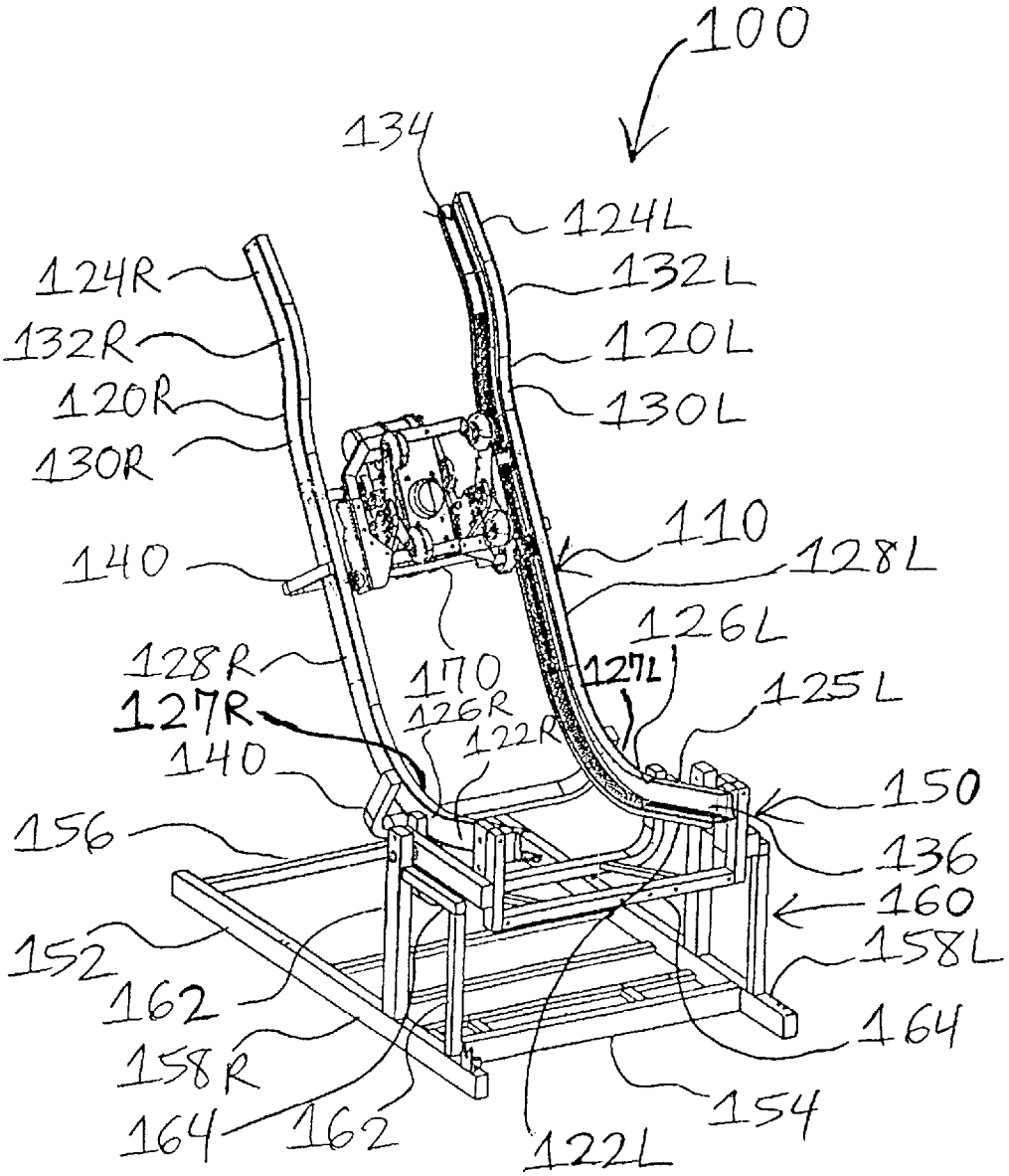
FIG. 10 is a perspective view of a body massage apparatus for a massage chair according to the present invention.
Figure 11:
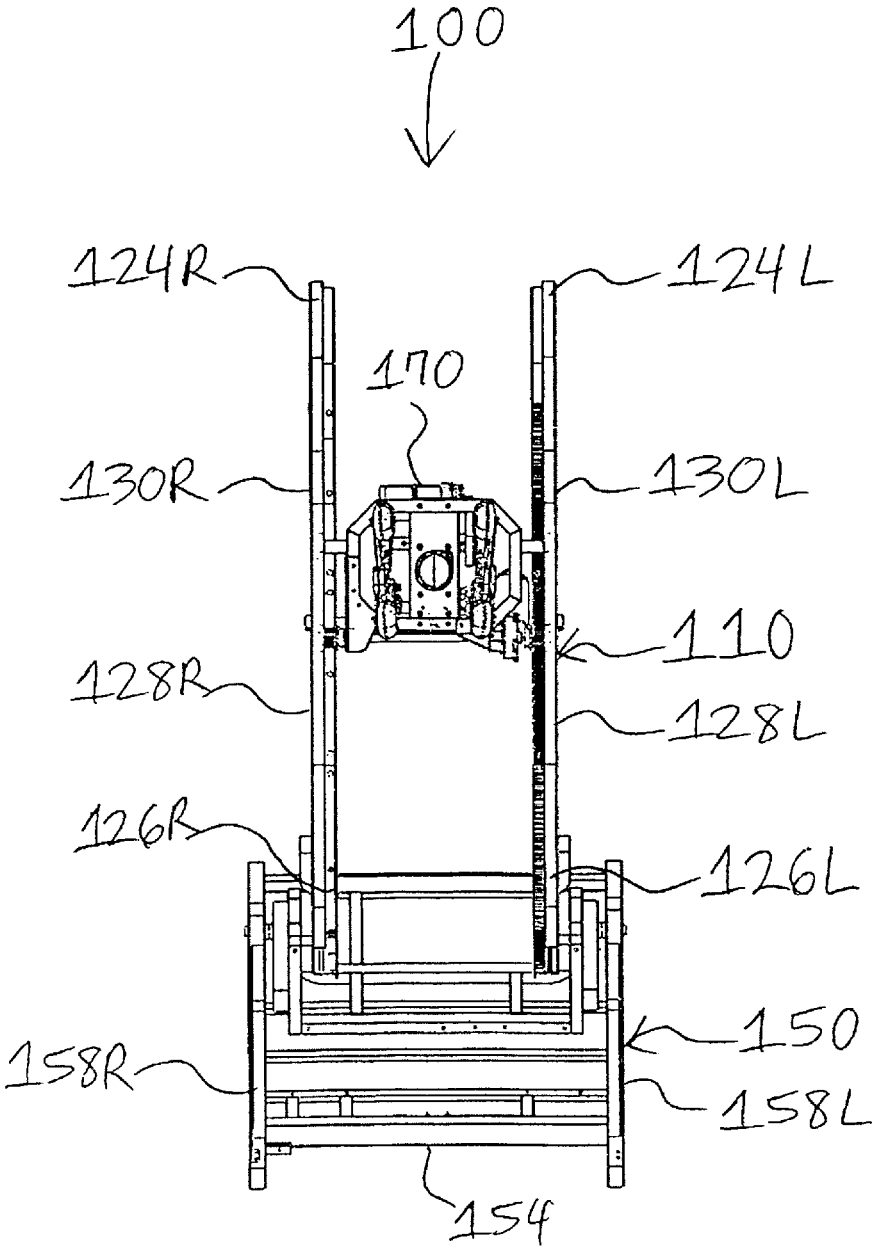
FIG. 11 is a front view of the body massage apparatus for a massage chair of FIG. 10.
Figure 12:
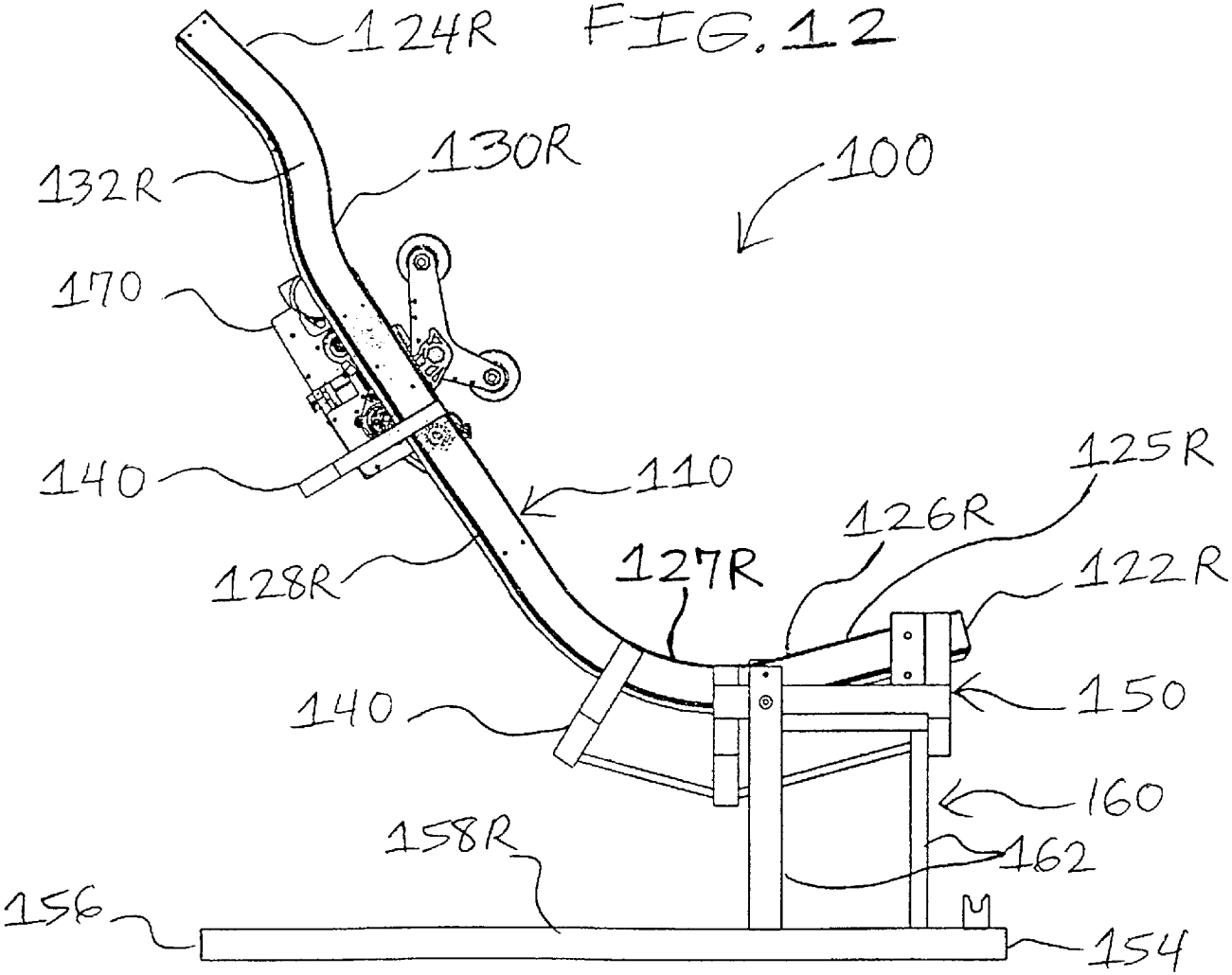
FIG. 12 is a right side view of the body massage apparatus for a massage chair of FIG. 10.

As a non-limiting example and best shown in FIGS. 10-12, the frame 110 of the body massage apparatus 100 includes a pair of opposing guide rails 120R,120L, a plurality of guide rails stabilizing bars 140, and a base stand 150. The guide rails 120R,120L are secured to the base stand 150, and are positioned generally above the base stand 150. The base stand 150 supports the weights of the guide rails 120R,120L, body massage device 170, and user (not shown) of the massage chair.

Preferably, the guide rails 120R,120L are substantially similar or mirror images of one another. Each of the guide rails 120R,120L includes a first end 122R,122L, a second end 124R,124L, a thigh body area portion 125R,125L located adjacent the first end 122R,122L, a seat or bottom body area portion 126R,126L located adjacent the thigh body area portion 125R,125L and away from the first end 122R,122L, a back body area portion 128R,128L extending upward from the bottom body area portion 126R,126L, a curved portion 127R,127L connecting the bottom body area portion 126R,126L and back body area portion 128R,128L, a head and neck body area portion 130R,130L extending upward from the back body area portion 128R,128L and located about the second end 124R,124L, an outer side 132R,132L, an inner side 134, and a guide channel 136 extending from the thigh body area portion 125R,125L to the back body area portion 128R,128L, preferably to the head and neck body area portion 130R,130L, and running along the inner side 134 of the guide rail 120R,120L. The guide channel 136 includes gear teeth 138 for engaging with at least one gear member from the body massage device 170 when the body massage device 170 moves upward and downward in a generally vertical direction from the first end 122R,122L toward the second end 124R,124L of the guide rail 120R,120L and vice versa, respectively. Preferably, each of the guide rails 120R,120L has a generally "L-shaped" configuration. In this configuration, the lower portion of the "L" includes the thigh body area portion 125R,125L and bottom body area portion 126R,126L, and the upper portion of the "L" includes the back body area portion 128R,128L and head and neck body area portion 130R,130L. As best shown in FIGS. 10 and 12, more preferably, each of the guide rails 120R,120L has a reclining "L-shaped" configuration.

The plurality of guide rails stabilizing bars 140 help to stabilize the positioning of the guide rails 120R,120L relative to one another. Each of the guide rails stabilizing bars 140 has a first end 142, a second end 144, and a body portion 146 extending from the first end 142 to the second end 144. Preferably, each of the guide rails stabilizing bars 140 has a generally "U-shaped" configuration. The guide rails stabilizing bars 140 are secured at predetermined locations along the outer sides 132R,132L of the guide rails 120R,120L.

The base stand 150 includes a base 152 and a guide rails support structure 160. The base 152 includes a first or front end 154, a second or rear end 156, and a pair of opposing sides 158R,158L. The guide rails support structure 160 is secured about the front end 154 of the base 152, and is positioned above the base 152. The guide rails support structure 160 includes a plurality of vertical bars or members 162 and a plurality of horizontal bars or members 164. The plurality of vertical bars 162 extend upward from the pair of opposing sides 158R,158L of the base 152, and, along with the plurality of horizontal bars 164, form a support frame with a "square-shaped" or "rectangular-shaped" box configuration.

Since the base stand 150 supports the weights of the guide rails 120R,120L, body massage device 170, and user of the massage chair, the base stand 150 is preferably made or manufactured of a strong material, such as, but not limited to, steel, metal, wood, hard plastic, any combination of the listed materials, and any material or combination of materials known to one of ordinary skill in the art. Also, the guide rails 120R,120L may be made or manufactured of steel, metal, wood, plastic, any combination of the listed materials, and any material or combination of materials known to one of ordinary skill in the art.

The body massage device 170 includes a power source, at least one massage element, and at least one gear member. The body massage device 170 may be a conventional massage device or any applicable massage device that is known to one of ordinary skill in the art.

As a non-limiting example and as best shown in FIGS. 13-17, the body massage device 170 includes a pair of massage device moving members 172R,172L, a pair of gear members 174R,174L, a pair of massage arms 180R,180L, a first motor 176, a second motor 178, a third motor 190, a rotational shaft 192 driven by the first motor 176, a pair of rotation to knocking translator members 194, a rotational shaft 195 driven by the second motor 178, a pair of rotation to kneading translator members 196, a rotational shaft 197 for vertical movement gears driving, a speed reduction belt 198 for the first motor 176, and a speed reduction belt 199 for the second motor 178.

Figure 13:
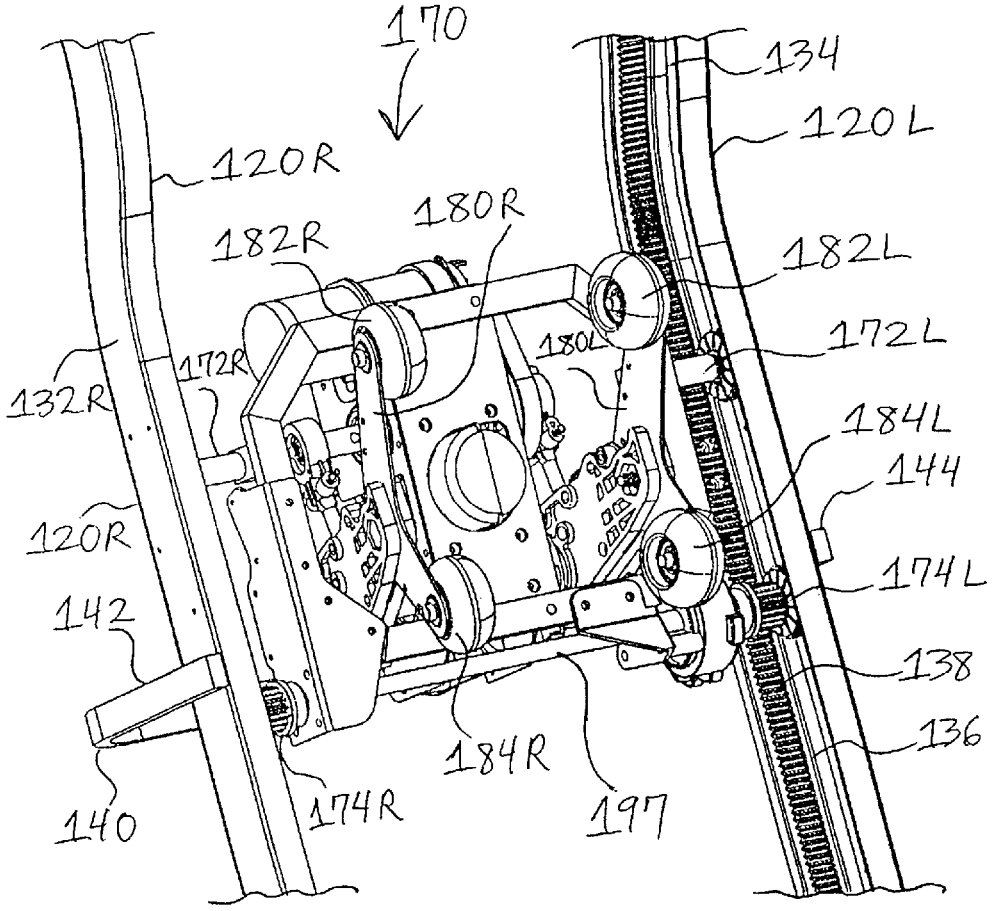
FIG. 13 is a perspective, front view of a massage device of the body massage apparatus for a massage chair of FIG. 10.
Figure 14:
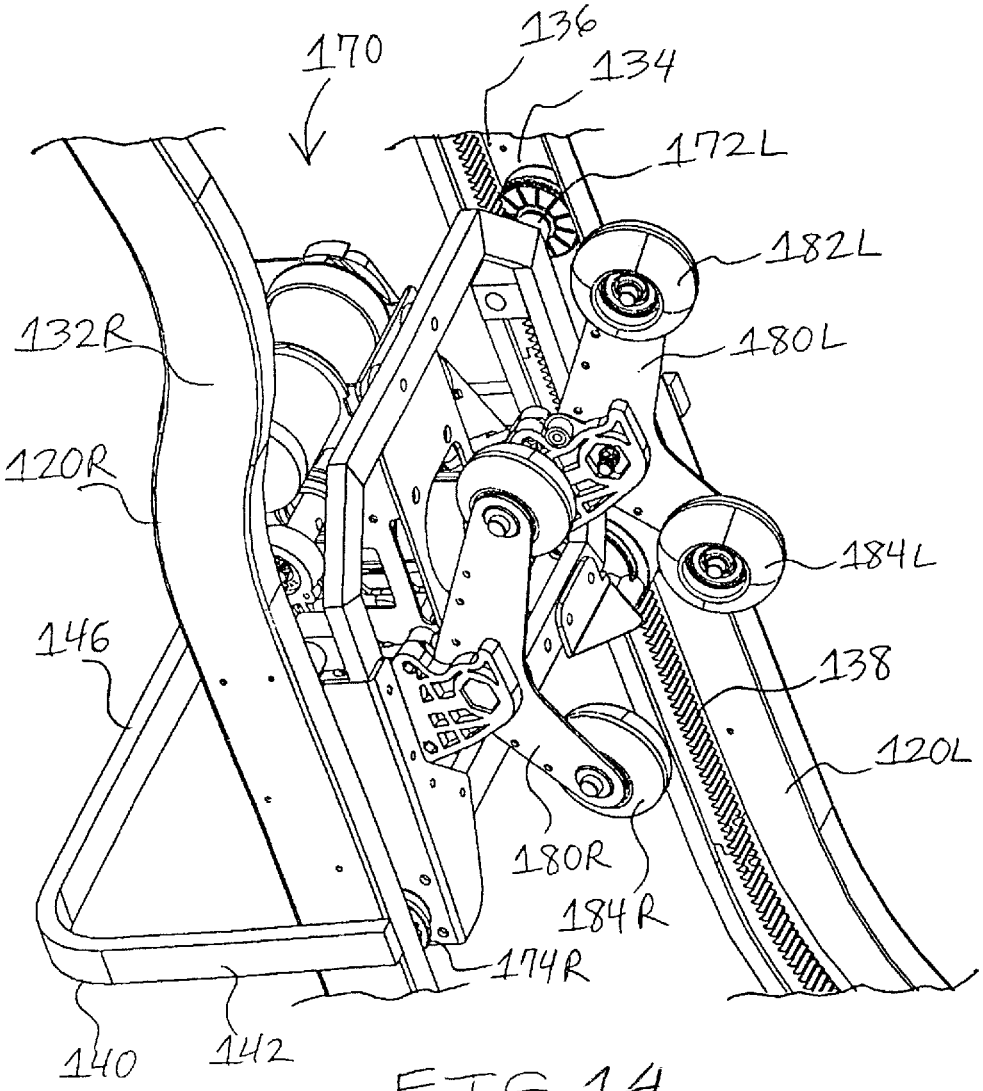
FIG. 14 is a perspective, front and right side view of a massage device of the body massage apparatus for a massage chair of FIG. 10.

As best shown in FIGS. 13 and 14, each of the pair of massage device moving members 172R,172L is positioned within a corresponding guide channel 136 of a guide rail 120R,120L, and helps the body massage device 170 move in a generally vertical direction along the guide channel 136.

As best shown in FIGS. 13 and 14, each of the pair of gear members 174R,174L is positioned within a corresponding guide channel 136 of a guide rail 120R,120L, and engages with the teeth 138 located in the corresponding guide channel 136.

As best shown in FIGS. 13-17, each of the pair of massage arms 180R,180L includes a first or upper massage roller 182R,182L and a second or lower massage roller 184R, 184L. Each of the pair of massage arms 180R,180L can move vertically. As a non-limiting example, each of the pair of massage arms 180R,180L may be able to move both vertically and laterally. The massage rollers 182R,182L, 184R,184L provide massage benefits or effects to a back body area, a bottom body area, and a thigh body area of the user when the body massage device 170 is moved to, near or about that particular body area. The massage rollers 182R,182L,184R,184L may also provide massage benefits or effects to a head and neck area of the user when the body massage device 170 is moved to, near or about the head and neck area. It will be understood by one of ordinary skill in the art that the timing of the pattern of the raising and lowering may be varied on each roller 182R,182L,184R, 184L, such as by adjusting the degree of rotation of one or more of the following: rotational shaft 192 driven by the first motor 176, pair of rotation to knocking translator members 194, rotational shaft 195 driven by the second motor 178, pair of rotation to kneading translator members 196, speed reduction belt 198 for the first motor 176, and speed reduction belt 199 for the second motor 178. Also, it will be understood by one of ordinary skill in the art that the rate of speed of rotation as well as the direction of rotation of the rollers 182R,182L,184R,184L may be adjusted by varying the motor speed or direction.

Figure 15:
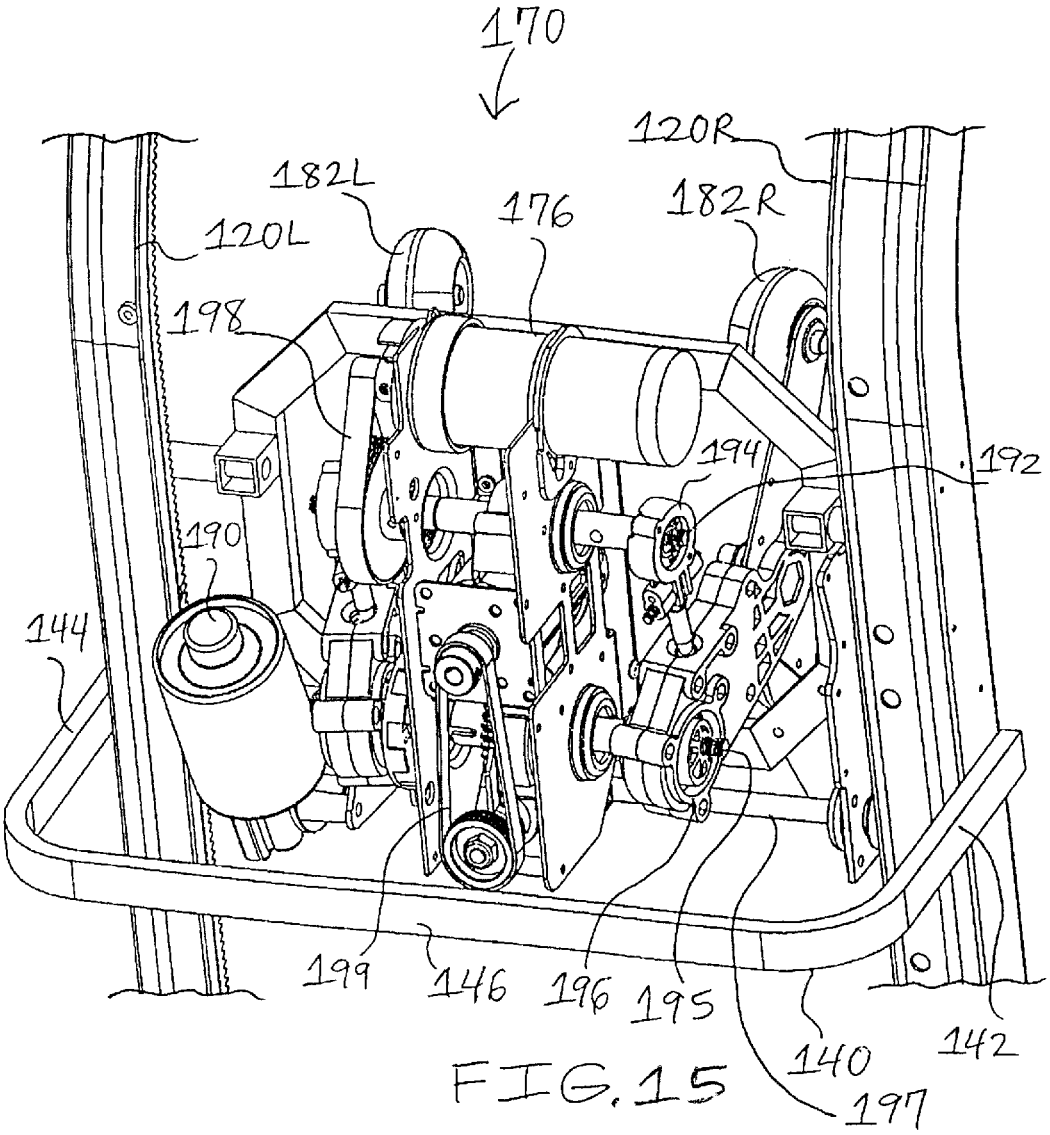
FIG. 15 is a perspective, rear view of a massage device of the body massage apparatus for a massage chair of FIG. 10.
Figure 16:
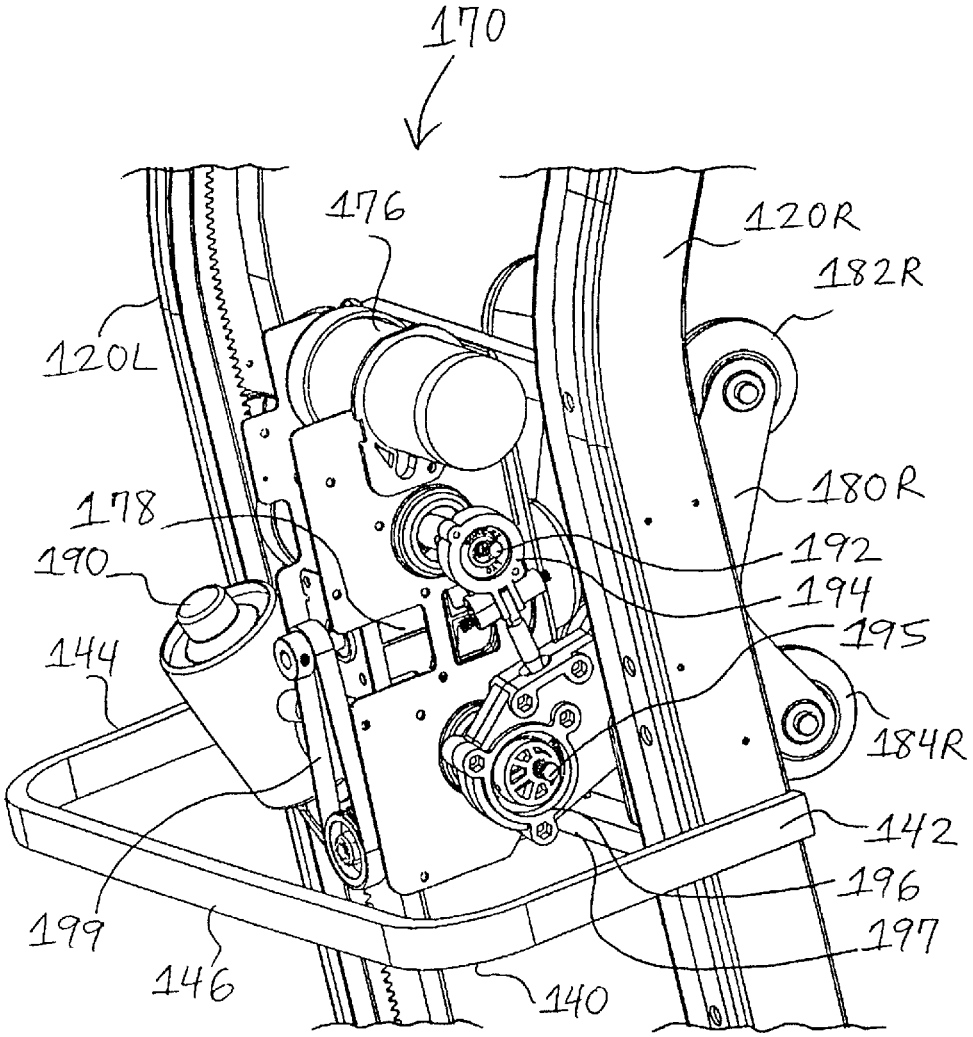
FIG. 16 is a perspective, rear and right side view of a massage device of the body massage apparatus for a massage chair of FIG. 10.
Figure 17:
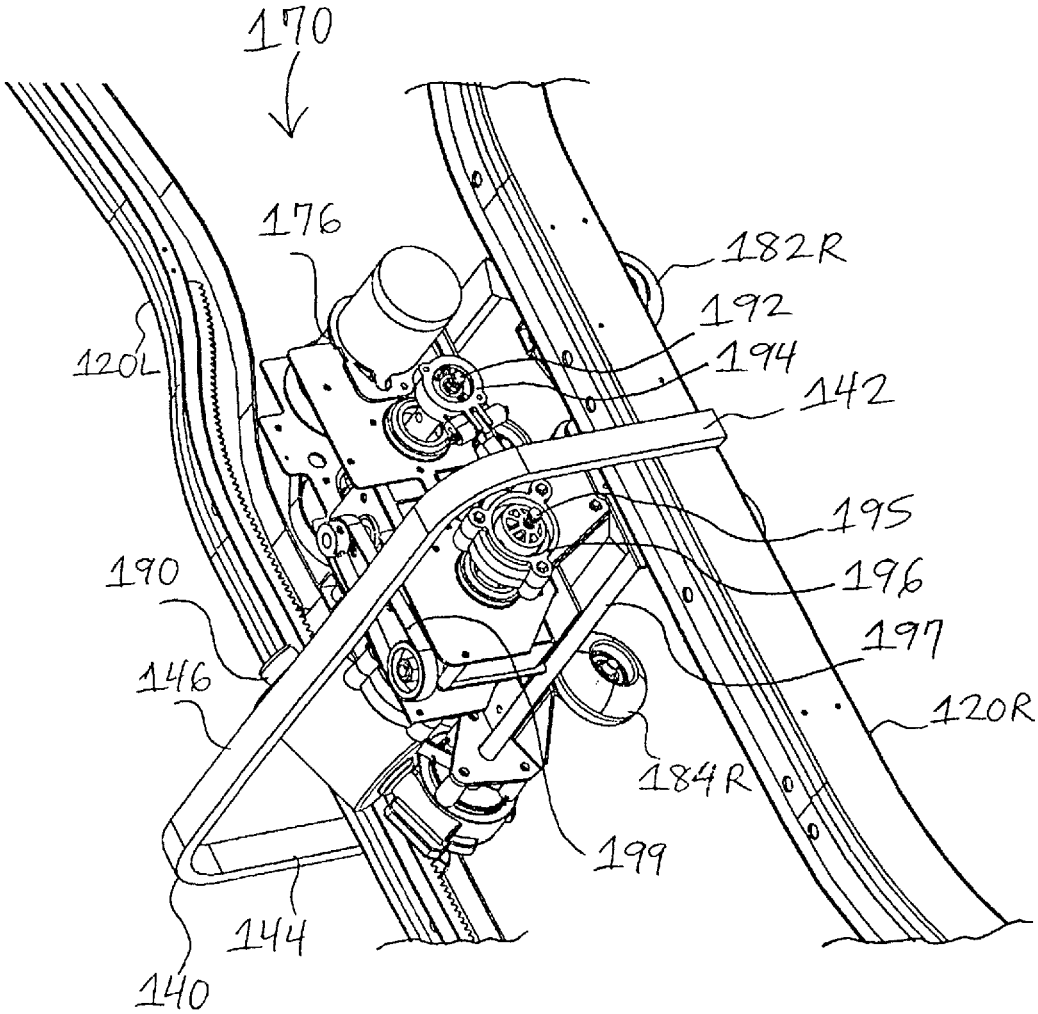
FIG. 17 is another perspective, rear and right side view of a massage device of the body massage apparatus for a massage chair of FIG. 10.

As best shown in FIGS. 15-17, the first and second motors 176,178 provide power to the pair of massage arms 180R, 180L, respectively, while the third motor 190 provides power for the generally vertical movement of the body massage device 170.

As best shown in FIGS. 15-17, the rotational shaft 192 driven by the first motor 176 causes the first massage arm 180R to be activated and to carry out its massage actions when this rotational shaft 192 is rotated.

As best shown in FIGS. 15-17, each of the pair of rotation to knocking translator members 194 assists the corresponding massage arm 180R,180L and corresponding massage roller(s) 182R,182L,184R,184L to carry out its knocking massage actions when the corresponding rotational shaft 192,195 is rotated.

As best shown in FIGS. 15-17, the rotational shaft 195 driven by the second motor 178 causes the second massage arm 180L to be activated and to carry out its massage actions when this rotational shaft 195 is rotated.

As best shown in FIGS. 15-17, each of the pair of rotation to kneading translator members 196 assists the corresponding massage arm 180R,180L and corresponding massage roller(s) 182R,182L,184R,184L to carry out its kneading massage actions when the corresponding rotational shaft 192,195 is rotated.

As best shown in FIGS. 15-17, the rotational shaft 197 for vertical movement gears driving causes the body massage device 170 to move upward or downward when this rotational shaft 197 is rotated.

As best shown in FIG. 15, the speed reduction belt 198 for the first motor 176 adjusts the speed of the first massage arm 180R.

As best shown in FIGS. 15-17, the speed reduction belt 199 for the second motor 178 adjusts the speed of the second massage arm 180L.

When in use or in operation, the user (not shown) may activate the body massage device 170 of the body massage apparatus 100 for a massage chair by or via pushing, touching, using voice command for use on or with, using a mechanical or remote control for use on or with, or any other activation method known to one of ordinary skill in the art, an activation, start, control or command button, touch area, box or panel, or any other activation method or element known to one of ordinary skill in the art. Preferably, the user is able to control the generally vertical movement of the body massage device 170 and massage rollers 182R,182L, 184R,184L upward and downward along the guide rails 120R,120L such that the body massage device 170 and massage rollers 182R,182L,184R,184L are positioned about, near or at a desired body part area, such as the thighs, bottom, lower back, upper back, and head and neck, of the user so that desired body part area of the user can receive massage effects or benefits from the massage rollers 182R, 182L,184R,184L when desired. Preferably, the user is also able to control the timing, movement, etc. of the massage rollers 182R,182L,184R,184L such that that the massage rollers 182R,182L,184R,184L can provide different massage effects or benefits, such as knocking, keading, etc., to the desired body part area of the user at a particular moment or time.

Referring to FIG. 18, the massage chair 200 includes a body massage apparatus and at least one health monitoring device or system 210. The body massage apparatus is preferably body massage apparatus 100, described above, that includes the frame 110 and body massage device 170, or is a body massage apparatus that is substantially similar to body massage apparatus 100.

As a non-limiting example shown in FIG. 18, the at least one health monitoring device or system 210 is a portable, wrist blood pressure and heart rate monitoring device 210 that is manufactured and/or programmed to measure or obtain the blood pressure and heart rate of the user right at or near the massage chair 200 when the user is preferably positioned on the massage chair 200. The blood pressure and heart rate monitoring device 210 is compact, convenient, and does not interfere with the massage functions of the massage chair 200. The blood pressure and heart rate monitoring device 210 provides blood pressure and heart rate measurements, and alerts the user and/or other persons, such as, but not limited to, an individual who is monitoring the user's blood pressure and heart rate. The measurement data 212 that is obtained from the user is displayed either on the device screen 214 or on a remote control 216 of the massage chair 200. The blood pressure and heart rate monitoring device 210 can be quickly connected to or disconnected from the massage chair 200 via a connector or cord 218, such as, but not limited to, a detachable DC power supply cord.

As an alternative to the blood pressure and heart rate monitoring device 210 of this embodiment, the at least one health monitoring device 210 may be a blood pressure monitoring or measuring device and a heart rate monitoring or measuring device that are separate from one another, or just either of those devices. As another alternative to the blood pressure and heart rate monitoring device 210 of this embodiment, the at least one health monitoring device 210 may encompass any individual or combinations of health monitoring functions, such as, but not limited to, blood pressure monitoring and/or measuring, heart rate monitoring or measuring, cholesterol monitoring or measuring, fat monitoring or measuring, and blood sugar monitoring or measuring. Alternatively, the at least one health monitoring device 210 may be or include any health monitoring device (s) that is/are known to one of ordinary skill in the art.

It is to be understood that the present invention is not limited to the embodiments described above or as shown in the attached figures, but encompasses any and all embodiments within the spirit of the invention.

The invention claimed is:

1. A legs and feet massage apparatus for providing massaging effects to the legs and feet of a user, said legs and feet massage apparatus comprising:

a legs and feet frame comprising a frame upper end and a frame lower end; and a legs and feet massage roller assembly supported by said legs and feet frame, wherein said legs and feet massage roller assembly comprises at least two sets of massage roller devices that are spaced apart in a direction that runs along said frame upper end to said frame lower end of said legs and feet frame, wherein each set of said at least two sets of massage roller devices is capable of providing massage effects to the feet of the user at the same time during operation when the feet of the user are located generally adjacent to each other and at a lower distal end of said legs and feet frame, wherein a first set of said at least two sets of massage roller devices is mounted on a first rotational shaft and is rotated by a motor, wherein a second set of said at least two sets of massage roller devices is mounted on a second rotational shaft, wherein said first set of said at least two sets of massage roller devices moves in a circular motion around an axis of said first rotational shaft, wherein said second set of said at least two sets of massage roller devices moves in a circular motion around an axis of said second rotational shaft, wherein said first rotational shaft is rotated around said axis of said first rotational shaft, wherein said second rotational shaft is rotated around said axis of said second rotational shaft, wherein said first rotational shaft and said second rotational shaft are not rotated around one another, and wherein at least one set of said at least two sets of massage roller devices is capable of traveling from a first position to a second position along said legs and feet frame.

2. The legs and feet massage apparatus according to claim 1, wherein said legs and feet frame comprises a pair of guide rails, wherein each of said guide rails comprises an upper end, a lower end, an upper section located closer to said upper end than said lower end, a lower section located closer to said lower end than said upper end, a connecting ankle curved section connecting said upper section and said lower section of a corresponding guide rail of said guide rails, and a guide channel, wherein each guide channel comprises an upper end, a lower end, an upper section located closer to said upper end of said each guide channel than said lower end of said each guide channel, a lower section located closer to said lower end of said each guide channel than said upper end of said each guide channel, and a connecting ankle curved section connecting said upper section of said each guide channel and said lower section of said each guide channel of a corresponding guide rail of said guide rails, wherein at least one of said guide channels comprises a plurality of gear teeth.

3. The legs and feet massage apparatus according to claim 2, wherein said guide rails of said legs and feet frame are opposing guide rails and are mirror images of one another.

4. The legs and feet massage apparatus according to claim 1, wherein said first and second rotational shafts are spaced apart in a direction along said legs and feet frame.

5. The legs and feet massage apparatus according to claim 1, further comprising at least one limit device that prevents said legs and feet massage roller assembly from exiting from at least one end of said legs and feet frame.

6. The legs and feet massage apparatus according to claim 5, wherein said at least one limit device is a sensor.

7. The legs and feet massage apparatus according to claim 5, wherein at least one limit device interfaces with a software to control said motor.

8. The legs and feet massage apparatus according to claim 1, wherein said legs and feet massage roller assembly further comprises a worm gear device, wherein said worm gear device is in communication with said motor such that said worm gear device is powered by said motor to rotate said first and second sets of massage roller devices via corresponding said first and second rotational shafts.

9. The legs and feet massage apparatus according to claim 1, wherein said legs and feet frame comprises a frame upper end, a frame lower end, an upper connecting bar, and a lower connecting bar, wherein each of said upper connecting bar and said lower connecting bar comprises a first end, a second end, and a body portion extending from said first end to said second end, and wherein said upper connecting bar is secured about said frame upper end of said legs and feet frame while said lower connecting bar is secured about said frame lower end of said legs and feet frame.

10. The legs and feet massage apparatus according to claim 1, further comprising at least one calf massage device for providing punching massaging effects to the calves of the user during operation.

11. The legs and feet massage apparatus according to claim 10, wherein said at least one calf massage device is at least one right calf massage device and at least one left calf massage device, and wherein each of said at least one right calf massage device and said at least one left calf massage device is secured along a frame upper end of said legs and feet frame.

12. The legs and feet massage apparatus according to claim 11, wherein said at least one right calf massage device is a right set of calf massage devices and said at least one left calf massage device is a left set of calf massage devices, wherein each of said right set of calf massage devices and of said left set of calf massage devices comprises an upper calf massage device and a lower calf massage device, wherein both of said upper calf massage device and said lower calf massage device of each set are secured along a frame upper end of said legs and feet frame wherein said upper calf massage devices face toward one another and said lower calf massage devices face toward one another.

13. The legs and feet massage apparatus according to claim 1, wherein said legs and feet frame comprises a securing member that secures said legs and feet frame to a massage chair body.

14. The legs and feet massage apparatus according to claim 1, wherein each of said at least two sets of massage roller devices can rotate in two directions.

15. The legs and feet massage apparatus according to claim 1, wherein both of said first set and said second set of said at least two sets of massage roller devices rotate at a same speed.

16. The legs and feet massage apparatus according to claim 1, wherein said at least two sets of massage roller devices comprise at least one set of smaller roller devices and at least one set of larger roller devices, and wherein said at least one set of smaller roller devices are located proximate to said at least one set of larger roller devices.

17. The legs and feet massage apparatus according to claim 1, wherein said legs and feet frame comprises a pair of guide channels that allows at least one of said at least two sets of massage roller devices to be moved to various positions along said legs and feet frame.

18. The legs and feet massage apparatus according to claim 1, wherein each set of said at least two sets of massage roller devices comprises at least one massage roller, and wherein each massage roller comprises an uneven surface wherein, when said each massage roller rotates, at least two points on said uneven surface draw two circles with unequal radii.

19. The legs and feet massage apparatus according to claim 1, wherein at least one set of said at least two sets of massage roller devices comprises at least one massage roller that supports a plurality of smaller massage rollers that can rotate during operation.

20. The legs and feet massage apparatus according to claim 1, wherein at least one set of said at least two sets of massage roller devices can rotate in a clockwise or a counterclockwise direction or back and forth for creating a massage effect.

21. The legs and feet massage apparatus according to claim 1, wherein at least one set of said at least two sets of massage roller devices can rotate at variable speeds during operation.

22. The legs and feet massage apparatus according to claim 1, further comprising a gear device mounted to said motor.

23. The legs and feet massage apparatus according to claim 22, wherein said gear device is a worm gear device.

24. The legs and feet massage apparatus according to claim 22, wherein said gear device and said motor are located between rollers of said first set of said at least two sets of massage roller devices.

25. The legs and feet massage apparatus according to claim 1, wherein each set of said at least two sets of massage roller devices comprises at least one massage roller, and wherein all massage rollers rotate at a same speed.

26. The legs and feet massage apparatus according to claim 1, wherein at least one set of said at least two sets of massage roller devices is capable of providing rolling massaging effects to backsides of calves of the user during operation.

27. The legs and feet massage apparatus according to claim 1, wherein said legs and feet frame is attachable to a massage chair.

28. The legs and feet massage apparatus according to claim 1, wherein said motor that rotates said first set of massage roller devices is a motor with a gear device, and wherein said first set of massage roller devices is capable of providing calf massage effects to the user.

29. The legs and feet massage apparatus according to claim 1, wherein said second set of massage roller devices is capable of providing calf massage effects to the user.

30. The legs and feet massage apparatus according to claim 1, wherein said second rotational shaft is parallel to said first rotational shaft.

31. The legs and feet massage apparatus according to claim 1, wherein said second set of said at least two sets of massage roller devices is rotated by said motor.

32. A massage chair comprising:

a body massage apparatus comprising a body frame and a body massage device, wherein said body frame comprises at least one guide rail having a guide channel, wherein each of said at least one guide rail has a configuration that allows said body massage device to travel from a back body area portion to a seat body area portion through a curved portion, wherein said body massage device comprises at least one massage element, and wherein, during operation, said body massage device moves along said at least one guide rail to provide massaging effects to a body area of a user;

a legs and feet frame comprising a frame upper end and a frame lower end; and a legs and feet massage roller assembly supported by said legs and feet frame, wherein said legs and feet massage roller assembly comprises at least two sets of massage roller devices that are spaced apart in a direction that runs along said frame upper end to said frame lower end of said legs and feet frame, wherein said at least two sets of massage roller devices are capable of providing massage effects to the feet of the user at the same time during operation when the feet of the user are located generally adjacent to each other and at said frame lower end of said legs and feet frame, wherein a first set of said at least two sets of massage roller devices is mounted on a first rotational shaft and is rotated by a motor, wherein a second set of said at least two sets of massage roller devices is mounted on a second rotational shaft, wherein said first set of said at least two sets of massage roller devices moves in a circular motion around an axis of said first rotational shaft, wherein said second set of said at least two sets of massage roller devices moves in a circular motion around an axis of said second rotational shaft, wherein said first rotational shaft is rotated around said axis of said first rotational shaft, wherein said second rotational shaft is rotated around said axis of said second rotational shaft, wherein said first rotational shaft and said second rotational shaft are not rotated around one another, and wherein at least one set of said at least two sets of massage roller devices is capable of providing massage effects to the calves of the user during operation.

33. The massage chair according to claim 32, wherein said legs and feet frame further comprises a pair of guide rails, wherein each of said guide rails of said legs and feet frame comprises an upper end, a lower end, an upper section located closer to said upper end than said lower end, a lower section located closer to said lower end than said upper end, a connecting ankle curved section connecting said upper section and said lower section of a corresponding guide rail of said guide rails, and a guide channel, wherein each guide channel of said guide rails of said legs and feet frame comprises an upper end, a lower end, an upper section located closer to said upper end of said each guide channel of said guide rails of said legs and feet frame than said lower end of said each guide channel of said guide rails of said legs and feet frame, a lower section located closer to said lower end of said each guide channel of said guide rails of said legs and feet frame than said upper end of said each guide channel of said guide rails of said legs and feet frame, and a connecting ankle curved section connecting said upper section of said each guide channel of said guide rails of said legs and feet frame and said lower section of said each guide channel of a corresponding guide rail of said guide rails of said legs and feet frame, and wherein at least one of said guide channels of said guide rails of said legs and feet frame comprises a plurality of gear teeth.

34. The massage chair according to claim 33, wherein said guide rails of said legs and feet frame are opposing guide rails and are mirror images of one another.

35. The massage chair according to claim 32, wherein said legs and feet frame has a generally "L-shaped" configuration.

36. The massage chair according to claim 32, further comprising at least one limit device that prevents said legs and feet massage roller assembly from exiting from at least one end of said frame upper end and said frame lower end of said legs and feet frame.

37. The massage chair according to claim 32, wherein said legs and feet massage roller assembly further comprises a worm gear device, wherein said worm gear device is in communication with said motor such that said worm gear device is powered by said motor to rotate said first and second sets of massage roller devices via corresponding said first and second rotational shafts so that said first and second sets of massage roller devices move along said legs and feet frame when driven by said worm gear device.

38. The massage chair according to claim 32, wherein said legs and feet frame further comprises an upper connecting bar and a lower connecting bar, wherein each of said upper connecting bar and said lower connecting bar comprises a first end, a second end, and a body portion extending from said first end to said second end, and wherein said upper connecting bar is secured about said frame upper end of said legs and feet frame while said lower connecting bar is secured about said frame lower end of said legs and feet frame.

39. The massage chair according to claim 32, further comprising at least one calf massage device for providing punching massaging effects to the calves of the user during operation.

40. The massage chair according to claim 39, wherein said at least one calf massage device is at least one right calf massage device and at least one left calf massage device, and wherein each of said at least one right calf massage device and said at least one left calf massage device is secured along said frame upper end of said legs and feet frame.

41. The massage chair according to claim 40, wherein said at least one right calf massage device is a right set of calf massage devices and said at least one left calf massage device is a left set of calf massage devices, wherein each of said right set of calf massage devices and of said left set of calf massage devices comprises an upper calf massage device and a lower calf massage device, wherein both of said upper calf massage device and said lower calf massage device of each set are secured along said frame upper end of said legs and feet frame wherein said upper calf massage devices face toward one another and said lower calf massage devices face toward one another.

42. The massage chair according to claim 32, further comprising a health monitoring device that performs at least one monitoring function selected from the group consisting of blood pressure monitoring, heart rate monitoring, cholesterol monitoring, fat monitoring, blood sugar monitoring, and any combination thereof.

43. The massage chair according to claim 32, wherein said body massage device comprises at least a pair of massage arms and a pair of rollers.

44. The massage chair according to claim 32, wherein said at least two sets of massage roller devices comprise at least one set of smaller roller devices and at least one set of larger roller devices, and wherein said at least one set of smaller roller devices are located proximate to said at least one set of larger roller devices.

45. The massage chair according to claim 32, wherein said body massage apparatus further comprises at least one motor to drive a driving gear.

46. The massage chair according to claim 32, wherein said back body area portion, said seat body area portion, and said curved portion of said guide channel of said at least one guide rail of said body frame are joined together.

47. The massage chair according to claim 32, wherein said guide channel of said at least one guide rail of said body frame further comprises a plurality of gear teeth.

48. The massage chair according to claim 47, wherein said plurality of gear teeth of said curved portion of said guide channel of said at least one guide rail of said body frame are pointing toward a center of said curved portion.

49. The massage chair according to claim 32, wherein a plurality of gear teeth of a guide channel of said at least one guide rail are located above an inner surface of said at least one guide rail.

50. The massage chair according to claim 32, wherein said body massage apparatus further comprises a speed reduction belt for motor speed reduction.

51. The massage chair according to claim 32, further comprising at least one health monitoring device configured to perform at least one health monitoring function for the user, and wherein said at least one health monitoring device is a health monitoring device that performs at least one monitoring function selected from the group consisting of blood pressure monitoring, heart rate monitoring, and any combination thereof.

52. The massage chair according to claim 32, wherein at least one set of said at least two sets of massage roller devices is capable of providing rolling massaging effects to backsides of calves of the user during operation.

53. The massage chair according to claim 32, wherein said legs and feet frame is attached to said body frame of said body massage apparatus.

54. The massage chair according to claim 32, further comprising at least one guide rails stabilizing bar, wherein at least one guide rails stabilizing bar of said at least one guide rails stabilizing bar has a generally "U-shaped" configuration.

55. The massage chair according to claim 32, further comprising at least one guide rails stabilizing bar, wherein at least one guide rails stabilizing bar of said at least one guide rails stabilizing bar is located proximate said frame lower end of said legs and feet frame.

56. The massage chair according to claim 32, wherein said body massage device further comprises a guide rail engagement mechanism comprised of at least one circular gear with a plurality of gear teeth evenly spaced around a gear body, and wherein said at least one circular gear is mounted on at least one rotation shaft and driven by at least one motor.

57. The massage chair according to claim 32, wherein at least one gear tooth of a plurality of gear teeth in a curved portion of said guide channel of at least one guide rail of said at least one guide rail has a tooth profile pointing to a direction perpendicular to said curved portion at a corresponding gear tooth.

58. The massage chair according to claim 32, wherein each gear tooth of a plurality of gear teeth of a left side guide channel of said guide channel of at least one guide rail of said at least one guide rail and of a right side guide channel of said guide channel of at least one guide rail of said at least one guide rail in said curved portion is positioned at a same position along a corresponding guide rail of said at least one guide rail.

59. The massage chair according to claim 32, wherein said guide channel of at least one guide rail of said at least one guide rail further comprises more than one portion joined along said at least one guide rail.

60. The massage chair according to claim 32, wherein a guide channel tooth profile of at least one gear tooth of a plurality of gear teeth in said guide channel of at least one guide rail of said at least one guide rail is elevated above an inner surface of said at least one guide rail.

61. The massage chair according to claim 32, wherein said first set of massage roller devices is capable of providing calf massage effects to the user.

62. The massage chair according to claim 32, wherein said second set of massage roller devices is capable of providing calf massage effects to the user.

63. The massage chair according to claim 32, wherein said second rotational shaft is parallel to said first rotational shaft.

64. The massage chair according to claim 32, wherein said second set of said at least two sets of massage roller devices is rotated by said motor.

65. The massage chair according to claim 32, wherein each set of said at least two sets of massage roller devices is capable of providing massage effects to the calves of the user at the same time during operation.

66. A massage chair comprising:

a body massage apparatus comprising a body frame and a body massage device, wherein said body frame comprises at least one guide rail having a guide channel, wherein each of said at least one guide rail has a configuration that allows said body massage device to travel from a back body area portion to a seat body area portion through a curved portion, wherein said body massage device comprises at least one massage element, and wherein, during operation, said body massage device moves along said at least one guide rail to provide massaging effects to a body area of a user;

a legs and feet frame comprising a frame upper end and a frame lower end; and a legs and feet massage roller assembly supported by said legs and feet frame, wherein said legs and feet massage roller assembly comprises at least two sets of massage roller devices that are spaced apart in a direction that runs along said frame upper end to said frame lower end of said legs and feet frame, wherein said at least two sets of massage roller devices are capable of providing massage effects to the feet of the user at the same time during operation when the feet of the user are located generally adjacent to each other and at said frame lower end of said legs and feet frame, wherein a first set of said at least two sets of massage roller devices is mounted on a first rotational shaft and is rotated by a motor, wherein a second set of said at least two sets of massage roller devices is mounted on a second rotational shaft, wherein said first set of said at least two sets of massage roller devices moves in a circular motion around an axis of said first rotational shaft, wherein said second set of said at least two sets of massage roller devices moves in a circular motion around an axis of said second rotational shaft, wherein said first rotational shaft is rotated around said axis of said first rotational shaft, wherein said second rotational shaft is rotated around said axis of said second rotational shaft, wherein said first rotational shaft and said second rotational shaft are not rotated around one another, and wherein said first set of said at least two sets of massage roller devices is capable of providing massage effects to the calves of the user during operation.

67. The massage chair according to claim 66, wherein said legs and feet frame further comprises a pair of guide rails, wherein each of said guide rails of said legs and feet frame comprises an upper end, a lower end, an upper section located closer to said upper end than said lower end, a lower section located closer to said lower end than said upper end, a connecting ankle curved section connecting said upper section and said lower section of a corresponding guide rail of said guide rails, and a guide channel, wherein each guide channel of said guide rails of said legs and feet frame comprises an upper end, a lower end, an upper section located closer to said upper end of said each guide channel of said guide rails of said legs and feet frame than said lower end of said each guide channel of said guide rails of said legs and feet frame, a lower section located closer to said lower end of said each guide channel of said guide rails of said legs and feet frame than said upper end of said each guide channel of said guide rails of said legs and feet frame, and a connecting ankle curved section connecting said upper section of said each guide channel of said guide rails of said legs and feet frame and said lower section of said each guide channel of a corresponding guide rail of said guide rails of said legs and feet frame, and wherein at least one of said guide channels of said guide rails of said legs and feet frame comprises a plurality of gear teeth.

68. The massage chair according to claim 67, wherein said guide rails of said legs and feet frame are opposing guide rails and are mirror images of one another.

69. The massage chair according to claim 66, wherein said legs and feet frame has a generally "L-shaped" configuration.

70. The massage chair according to claim 66, further comprising at least one limit device that prevents said legs and feet massage roller assembly from exiting from at least one end of said frame upper end and said frame lower end of said legs and feet frame.

71. The massage chair according to claim 66, wherein said legs and feet massage roller assembly further comprises a worm gear device, wherein said worm gear device is in communication with said motor such that said worm gear device is powered by said motor to rotate said first and second sets of massage roller devices via corresponding said first and second rotational shafts so that said first and second sets of massage roller devices move along said legs and feet frame when driven by said worm gear device.

72. The massage chair according to claim 66, wherein said legs and feet frame further comprises an upper connecting bar and a lower connecting bar, wherein each of said upper connecting bar and said lower connecting bar comprises a first end, a second end, and a body portion extending from said first end to said second end, and wherein said upper connecting bar is secured about said frame upper end of said legs and feet frame while said lower connecting bar is secured about said frame lower end of said legs and feet frame.

73. The massage chair according to claim 66, further comprising at least one calf massage device for providing punching massaging effects to the calves of the user during operation.

74. The massage chair according to claim 73, wherein said at least one calf massage device is at least one right calf massage device and at least one left calf massage device, and wherein each of said at least one right calf massage device and said at least one left calf massage device is secured along said frame upper end of said legs and feet frame.

75. The massage chair according to claim 74, wherein said at least one right calf massage device is a right set of calf massage devices and said at least one left calf massage device is a left set of calf massage devices, wherein each of said right set of calf massage devices and of said left set of calf massage devices comprises an upper calf massage device and a lower calf massage device, wherein both of said upper calf massage device and said lower calf massage device of each set are secured along said frame upper end of said legs and feet frame wherein said upper calf massage devices face toward one another and said lower calf massage devices face toward one another.

76. The massage chair according to claim 66, further comprising a health monitoring device that performs at least one monitoring function selected from the group consisting of blood pressure monitoring, heart rate monitoring, cholesterol monitoring, fat monitoring, blood sugar monitoring, and any combination thereof.

77. The massage chair according to claim 66, wherein said body massage device comprises at least a pair of massage arms and a pair of rollers.

78. The massage chair according to claim 66, wherein said at least two sets of massage roller devices comprise at least one set of smaller roller devices and at least one set of larger roller devices, and wherein said at least one set of smaller roller devices are located proximate to said at least one set of larger roller devices.

79. The massage chair according to claim 66, wherein said body massage apparatus further comprises at least one motor to drive a driving gear.

80. The massage chair according to claim 66, wherein said back body area portion, said seat body area portion, and said curved portion of said guide channel of said at least one guide rail of said body frame are joined together.

81. The massage chair according to claim 66, wherein said guide channel of said at least one guide rail of said body frame further comprises a plurality of gear teeth.

82. The massage chair according to claim 81, wherein said plurality of gear teeth of said curved portion of said guide channel of said at least one guide rail of said body frame are pointing toward a center of said curved portion.

83. The massage chair according to claim 66, wherein a plurality of gear teeth of a guide channel of said at least one guide rail are located above an inner surface of said at least one guide rail.

84. The massage chair according to claim 66, wherein said body massage apparatus further comprises a speed reduction belt for motor speed reduction.

85. The massage chair according to claim 66, further comprising at least one health monitoring device configured to perform at least one health monitoring function for the user, and wherein said at least one health monitoring device is a health monitoring device that performs at least one monitoring function selected from the group consisting of blood pressure monitoring, heart rate monitoring, and any combination thereof.

86. The massage chair according to claim 66, wherein at least one set of said at least two sets of massage roller devices is capable of providing rolling massaging effects to backsides of calves of the user during operation.

87. The massage chair according to claim 66, wherein said legs and feet frame is attached to said body frame of said body massage apparatus.

88. The massage chair according to claim 66, further comprising at least one guide rails stabilizing bar, wherein at least one guide rails stabilizing bar of said at least one guide rails stabilizing bar has a generally "U-shaped" configuration.

89. The massage chair according to claim 66, further comprising at least one guide rails stabilizing bar, wherein at least one guide rails stabilizing bar of said at least one guide rails stabilizing bar is located proximate said frame lower end of said legs and feet frame.

90. The massage chair according to claim 66, wherein said body massage device further comprises a guide rail engagement mechanism comprised of at least one circular gear with a plurality of gear teeth evenly spaced around a gear body, and wherein said at least one circular gear is mounted on at least one rotation shaft and driven by at least one motor.

91. The massage chair according to claim 66, wherein at least one gear tooth of a plurality of gear teeth in a curved portion of said guide channel of at least one guide rail of said at least one guide rail has a tooth profile pointing to a direction perpendicular to said curved portion at a corresponding gear tooth.

92. The massage chair according to claim 66, wherein each gear tooth of a plurality of gear teeth of a left side guide channel of said guide channel of at least one guide rail of said at least one guide rail and of a right side guide channel of said guide channel of at least one guide rail of said at least one guide rail in said curved portion is positioned at a same position along a corresponding guide rail of said at least one guide rail.

93. The massage chair according to claim 66, wherein said guide channel of at least one guide rail of said at least one guide rail further comprises more than one portion joined along said at least one guide rail.

94. The massage chair according to claim 66, wherein a guide channel tooth profile of at least one gear tooth of a plurality of gear teeth in said guide channel of at least one guide rail of said at least one guide rail is elevated above an inner surface of said at least one guide rail.

95. The massage chair according to claim 66, wherein said first set of massage roller devices is capable of providing calf massage effects to the user.

96. The massage chair according to claim 66, wherein said second set of massage roller devices is capable of providing calf massage effects to the user.

97. The massage chair according to claim 66, wherein said second rotational shaft is parallel to said first rotational shaft.

98. The massage chair according to claim 66, wherein said second set of said at least two sets of massage roller devices is rotated by said motor.

99. The massage chair according to claim 66, wherein each set of said at least two sets of massage roller devices is capable of providing massage effects to the calves of the user at the same time during operation.

* * * * *